US011839297B2

(12) United States Patent
Rehage et al.

(10) Patent No.: US 11,839,297 B2
(45) Date of Patent: Dec. 12, 2023

(54) FURNITURE ELEMENT

(71) Applicant: PAUL HETTICH GMBH & CO. KG, Kirchlengern (DE)

(72) Inventors: Daniel Rehage, Münster (DE); Andreas Matthes, Chemnitz (DE); Ulrich Siegert, Limbach-Oberfrohna (DE); Bernd Lehmann, Chemnitz (DE); Mathias Winkler, Chemnitz (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 97 days.

(21) Appl. No.: 17/603,625

(22) PCT Filed: Apr. 15, 2020

(86) PCT No.: PCT/EP2020/060509
§ 371 (c)(1),
(2) Date: Oct. 14, 2021

(87) PCT Pub. No.: WO2020/212373
PCT Pub. Date: Oct. 22, 2020

(65) Prior Publication Data

US 2022/0211176 A1 Jul. 7, 2022

(30) Foreign Application Priority Data

Apr. 15, 2019 (DE) ..... 10 2019 109 866.1

(51) Int. Cl.
*A47B 49/00* (2006.01)
*A47B 9/00* (2006.01)
(Continued)

(52) U.S. Cl.
CPC ..... *A47B 49/006* (2013.01); *A47B 9/00* (2013.01); *A47B 53/00* (2013.01); *A47B 77/10* (2013.01); *A47B 85/00* (2013.01)

(58) Field of Classification Search
CPC ..... A47B 49/006; A47B 9/00; A47B 53/00; A47B 77/10; A47B 85/00
(Continued)

(56) References Cited

U.S. PATENT DOCUMENTS 330,409 A * 11/1885 Larson ..... A47B 46/00 312/283
535,886 A * 3/1895 Brand ..... F04D 25/08 5/96
(Continued)

FOREIGN PATENT DOCUMENTS

DE 102017106170 A1 9/2018
DE 102017120160 A1 3/2019
(Continued)

OTHER PUBLICATIONS

International Search Report dated May 19, 2020 in related/corresponding International Application No. PCT/EP2020/060509.
(Continued)

*Primary Examiner* — Daniel J Troy
*Assistant Examiner* — Timothy M Ayres
(74) *Attorney, Agent, or Firm* — PATENT PORTFOLIO BUILDERS PLLC

(57) ABSTRACT

A furniture element, in particular a shelf or shelving unit has at least one storage level, a body, and a bottom plate. Storage surfaces of the body, which face each other, and the bottom plate each have raceways, in which rolling elements are guided. The body is movable relative to the bottom plate from an initial position to an intermediate position and back, wherein, in the intermediate position, the body is rotated
(Continued)

relative to the bottom plate in a rotation direction and shifted in a predetermined direction, the raceways of the bottom plate being formed having mirror symmetry to an axis of symmetry extending at an oblique angle relative to a lateral edge of the bottom plate.

21 Claims, 21 Drawing Sheets

(51) Int. Cl.
*A47B 53/00* (2006.01)
*A47B 85/00* (2006.01)
*A47B 77/10* (2006.01)

(58) Field of Classification Search
USPC ..... 312/204, 205
See application file for complete search history.

(56) References Cited

U.S. PATENT DOCUMENTS

| | | | | |
|---|---|---|---|---|
| 2,650,871 | A * | 9/1953 | Holderegger | A47B 88/48 16/374 |
| 4,124,262 | A * | 11/1978 | Schill | A47B 49/004 312/307 |
| 4,959,582 | A | 9/1990 | Meyer et al. | |
| 11,000,124 | B2 | 5/2021 | Rehage et al. | |
| 11,098,758 | B2 | 8/2021 | Rehage et al. | |
| 2005/0196311 | A1 | 9/2005 | Krayer | |
| 2006/0284529 | A1 | 12/2006 | Milutinovics et al. | |

FOREIGN PATENT DOCUMENTS

| | | | |
|---|---|---|---|
| EP | 0577551 | A1 | 1/1994 |
| JP | H10318669 | A | 12/1998 |
| WO | 2019042921 | A1 | 3/2019 |

OTHER PUBLICATIONS

Search Report dated Nov. 25, 2019 in related/corresponding DE Application No. 10 2019 109 866.1.
Written Opinion dated May 19, 2020 in related/corresponding International Application No. PCT/EP2020/060509.

* cited by examiner

FURNITURE ELEMENT

BACKGROUND AND SUMMARY OF THE INVENTION

Exemplary embodiments of the present invention relate to a furniture element, in particular a shelf or shelving unit.

Furniture elements such as shelves or shelving units in which a support plate and a shelf guided thereon and simultaneously movable in rotation and translation are arranged are known, for example, from JP 10318669 or DE 10 2017 106 170 A1.

In particular, the support plate described in the latter publication has proven itself in practice.

In the case of such shelves or shelving units, there is often the problem of protecting the items stored on them from dirt on the one hand and allowing good accessibility to the items on the other. Furthermore, these shelves or shelving units must always be placed at a distance from side walls to allow them to be rotated without hitting the side wall.

Exemplary embodiments of the present invention are directed to a furniture element consisting of at least one bottom plate and a body, in particular a shelf or shelving unit, which equally ensures protection of the objects stored on or in the furniture element and good accessibility thereto. The furniture element is also to be further developed to enable further improved support of a body of the furniture element on a bottom plate and to be able to rotate furniture elements positioned on an interfering contour, such as a wall or in a corner. A body is a furniture component having a bottom and at least one closed side wall, behind which at least one storage element, for example a shelf, is arranged.

The furniture element comprises a bottom plate arranged on a body of the furniture element.

Bearing surfaces of the body and bottom plate facing each other have respective raceways in which rolling elements are guided.

The body of the furniture element can be moved relative to the bottom plate from an initial position to an intermediate position and further to an open position and back.

In the intermediate position, the body is rotated relative to the bottom plate in one direction of rotation and displaced in a predetermined direction. In the initial position and in the open position, the body is congruent with the bottom plate, i.e., it does not protrude beyond the dimensions of the bottom plate, but the body is rotated by 180° in each case.

In the event that the body in the initial position overlaps the bottom plate in dimensions, or vice versa, the same condition (same alignment/same overlap) is restored in the opening position, only with the body rotated by 180°.

If there is more than one raceway, one of the preferably two raceways of the bottom plate can be designed as a raceway open towards one edge of the bottom plate.

In the case of the furniture element, the at least one raceway of the bottom plate is in each case formed mirror-symmetrically with respect to an axis of symmetry running at an oblique angle to a side edge of the bottom plate.

In the case of the furniture element, at least one raceway of the bearing plate can additionally be formed mirror-symmetrically in each case with respect to an axis of symmetry running at an oblique angle to a side edge of the bearing plate.

Such a furniture element can be placed, for example, in a corner of a room consisting of two side walls at an angle to one another and turned out of this corner of the room in a simple manner, so that the furniture element is placed in an initial position, for example, in such a way that the furniture element is covered by side walls of the body and, in an opening position turned through 90° or 180°, for example, is turned out of the corner in such a way that the at least one storage level of the furniture element is freely accessible by a user.

Such a furniture element according to the invention, standing against a wall of a room or in a corner of a room, can be moved from a position closed by side walls of the body of the furniture element to an open position by turning while maintaining the same basic position.

Thus, an at least partially combined translation-rotation movement of the furniture element enables access to the contents of the furniture element in a simple manner. The proportions of translation and rotation in the overall movement can vary depending on the design of the raceways over the course of the movement.

Unlike conventional furniture elements, there are no obstructing doors, flaps or front panels in the access position that can hinder access.

According to an advantageous embodiment of the furniture element, the axis of symmetry extends at an angle of 45° to a side edge of the bottom plate and/or the bearing plate.

In particular, this allows the furniture element to rotate about an axis perpendicular to the plane of the raceways out of a right-angled corner of the room, wherein the furniture element performs a rotational movement of 45° to a side edge of the bottom plate with at least partial simultaneous translation.

According to one embodiment variant, a base of the body has a recess on its side facing the bottom plate, in which a bearing plate is fastened, in whose side facing the bottom plate at least one raceway is formed. Alternatively, the bearing plate can also be formed integrally with the base of the body.

This enables a furniture element, which was previously equipped without the possibility of translational-rotational movement, to be easily fitted and, if necessary, retrofitted with such a bearing plate and the components connected to it to enable such a translational-rotational movement.

According to a further embodiment variant, the raceways formed in the bearing surface of the body are designed as closed, circumferential raceways and thus enable reliable guidance of the rolling elements.

Preferably, the bottom plate, the bearing plate, the rolling elements, and the rolling element cage form a translational-rotational bearing. Such a translational rotational bearing can be provided as a kit and can in particular also be integrated subsequently into the base of a furniture element.

Preferably, the furniture element can have a body having at least one closed side wall. This body can be designed in such a way that, in an initial situation, the contents of the furniture element are concealed and thus kitchen utensils, such as a coffee machine or kettle, can easily "disappear" when not in use.

This allows a very aesthetic design of the kitchen or other living or working rooms or bathrooms, as well as their furniture. This is especially beneficial in open space concepts and meeting rooms.

According to a further embodiment variant, the body of the furniture element has a plurality of storage levels, thereby multiplying the storage space of the furniture element in a simple manner.

According to a further embodiment, the rolling elements are captively accommodated in at least one rolling element cage, which in particular facilitates mounting of the rolling elements between the raceways.

According to a further embodiment variant, a further translational-rotational bearing is fixed to a cover plate of the furniture body. This enables, in particular, the arrangement of such a furniture element in a piece of furniture such as, for example, a cooking island or, for example, also in a corner of a kitchen furniture structure which is open on two sides. This ensures good running behavior of the furniture element and prevents it from tilting.

In particular, such an arrangement has the advantage over a pharmacist's drawer that by guiding the furniture element via two such bearings, simultaneous approach of the furniture element in both bearings, in particular at the bottom and at the top, is realized.

In such an arrangement of two bearings on a furniture element, also known as a "tandem arrangement", it is important to maintain a suitable ratio of the overall height or the distance between the bearings to the diameter of the bearing or the curved tracks formed in the bearing. If the ratio is unfavorable, for example if the diameter of the bearings is small and the distance between the bearings is large, tilting can easily occur, since it is not always possible to ensure that the upper and lower bearings run loose at the same time.

In addition, exclusively linear guidance of the rolling elements, as in the case of the pharmacist's drawer, can easily lead to tilting of the furniture element. In contrast, the combined translational and rotational motion reduces tilting because the rolling elements are guided over the entire surface.

According to a preferred embodiment variant, the raceways formed in the bearing plate form at least one outer raceway and one inner raceway.

According to a preferred further development, a third raceway is formed between the outer raceway and the inner raceway. Such a third raceway serves to perform additional functions such as, in particular, limiting the rotation of the furniture element. In this case, such a third raceway must also be formed in the bottom plate.

According to a further embodiment variant, a fixing device is provided on the body of the furniture element for vertical fixing of the bottom plate.

According to a further embodiment variant, the bottom plate has a slot into which a guide sleeve protrudes from the underside of the base facing the bottom plate and thus guides the translational movement. Particularly in the case of asymmetrical loads, this ensures a permanent connection between the bearing plate and the bottom plate, and thus the functionality of the bearing.

A piece of furniture according to the invention comprises a body having a plurality of side walls and/or partitions and a cover plate. At least one furniture element as described above is arranged in the furniture according to the invention.

Particularly preferably, the furniture element is arranged in a corner area of the furniture.

Particularly preferably, such furniture elements are arranged in at least two corner areas of the furniture.

A further piece of furniture according to the invention comprises at least two furniture elements according to the invention, which are arranged in a tandem arrangement with translational-rotational bearings as described above, and a cover plate which covers the at least two furniture elements. This piece of furniture explicitly avoids the use of rigid side or partition walls to connect the base to the cover plate. Thus, the cover plate is supported exclusively by the at least two furniture elements according to the invention, and the stability of the furniture is ensured by the bearing of the built-in at least two furniture elements. This makes it possible, in particular, to arrange such a furniture element in a free-standing piece of furniture.

In a preferred variant, a further piece of furniture according to the invention having a first body and a furniture element comprises a body that can be placed in a fixed position on a floor by friction.

Such a piece of furniture can be used, for example, as a table, in particular a desk or also as a kitchen worktable, in which the furniture element can be moved relative to the fixed furniture body with the aid of the translational-rotational bearing relative to the fixed furniture body from a position of the furniture element covering the body into a position of the furniture element not completely covering the body and back.

For example, in the open position, the furniture element can be aligned perpendicularly to the fixed furniture body. A first lifting device can additionally be attached to the body.

In this case, the furniture element can have a second lifting device that can be synchronously actuated with the first lifting device, wherein the translational-rotational bearing of the furniture element is mounted on the first lifting device.

BRIEF DESCRIPTION OF THE DRAWING FIGURES

Preferred embodiment variants are explained in more detail below with reference to the accompanying drawings, wherein:

FIG. 1 shows a schematic perspective view of an embodiment variant of a furniture element according to the invention, arranged in a corner of a room, FIG. 2 shows a representation of the furniture element corresponding to FIG. 1 in a position rotated out of the corner of the room by an angle, FIG. 3 shows a representation of the furniture element corresponding to FIG. 1 in an open position rotated by 180°, FIG. 4 shows a perspective view of the furniture element shown in FIGS. 1-3 with the bottom plate removed to show the raceways, FIG. 5 shows a top view of an alternative embodiment variant of a raceway design and correspondingly adapted rolling element cage, FIG. 6 shows a top view of further alternative embodiment variants of rolling element cages, FIG. 7 shows a perspective exploded view of an alternative embodiment variant of a furniture element according to the invention, accommodated in a furniture body, having two bearings allowing a combined translational-rotational movement, FIGS. 8-11 show perspective views of the embodiment variant according to FIG. 7 in different positions, FIG. 12 shows a perspective view of the embodiment variant according to FIG. 7 in the position shown in FIG. 8 with only dashed contours of the furniture body, FIGS. 13-15 show schematic top views of the furniture body according to FIGS. 8 to 11 to show possible arrangements of the furniture element according to FIG. 7 in the furniture body, and FIGS. 16-22 show schematic views of a further alternative embodiment variant of a furniture element according to the invention, which can be moved in translation and rotation relative to a furniture body.

DETAILED DESCRIPTION

In the following figure description, terms such as top, bottom, left, right, front, rear, etc. refer exclusively to the exemplary representation and position of the furniture element, body, raceways, bottom plate, rolling elements and the like selected in the respective figures. These terms are not to be understood restrictively, i.e., these references may change due to different working positions or the mirror-symmetrical design or the like.

In FIGS. 1 to 4, a first variant of a furniture element according to the invention is designated by the reference sign 2.

In FIGS. 7 to 15, the reference sign 3 indicates an alternative embodiment variant of a furniture element.

In FIGS. 16 to 22, the reference sign 12 indicates a further alternative embodiment variant of a furniture element.

The furniture element 2 shown in FIGS. 1 to 4 is designed by way of example as a shelf having a square base and three storage compartments.

The furniture element 2 comprises a body 22, having a base 23 and a plurality of shelves 25. The uppermost of the shelves 25 here forms the top of the shelf, so that the latter is designed to be closed at the top.

The body 22 of the furniture element 2 further comprises two side walls 24, which enclose the furniture element 2 from two sides.

The furniture element 2 further comprises a bottom plate 21 arranged on the body 22, in this case on the base 23 of the furniture element 2.

Bearing surfaces of the body 22 and the bottom plate 21 facing one another have respective raceways 27, 28 in which rolling elements 51 are guided, which serve for the movable bearing of the body 22 relative to the bottom plate 21.

In the first exemplary embodiment, according to FIG. 4, the raceways 27 associated with the body 22 are arranged on a bearing plate 26, which is fixed to the base 23 of the body 22. However, the bearing plate 26 can also be an integral part of the base 23.

The rolling elements 51 are mounted in a rolling element cage 5, which in the embodiment variant shown here is designed as a square-shaped frame having a total of eight rolling elements 51 mounted therein, preferably designed as balls.

Depending on the degree of surface pressure and thus the forces acting on the rolling elements 51, it is conceivable to vary the number and/or the diameter of the rolling elements 51 in order to achieve a desired surface pressure.

The rolling elements 51 are arranged in the corners of the rolling element cage 5, which is designed as a square frame, respectively for improved support of the body 22 relative to the bottom plate 21. Four further rolling elements are placed centrally on the respective sides of the rolling element cage 5.

While the raceways 27 on the underside of the bearing plate 26 facing the bottom plate 21 are formed as closed, circumferential raceways, the preferably two raceways 28 of the bottom plate 21 are each formed mirror-symmetrically to an axis of symmetry extending at an oblique angle, preferably 45° to a side edge of the bottom plate 21.

In the embodiment variant shown here, the axis of symmetry extends parallel to the side edge of the bottom plate 21.

One of these two raceways 28 is formed as a closed, circumferential raceway. The second of these raceways 28 is designed in such a way that ends of this raceway open into two side edges of the bottom plate 21 which are at an angle to each other and are thus designed as open raceways.

The choice of an open and a closed raceway thereby enables sufficient stabilization of the furniture element 2 both at rest and during rotation of the furniture element 2, provided that a surface overlap between the bottom plate 21 and the body 22 of the furniture element 2 is at least 50% in each position.

If the surface overlap between the bottom plate and the body of the furniture element 2 is less than 50% in any position, more than one open raceway is necessary to ensure sufficient stabilization of the furniture element 2 both at rest and during rotation of the furniture element 2.

In general, sufficient stabilization of the furniture element 2 both at rest and during rotation of the furniture element 2 is possible by varying the type and number of raceways, the orientation and positioning of the raceways relative to the desired direction of the translational movement and, optionally, further supporting functional elements such as the fixing device 7 mentioned further below.

This design of the raceways 28 and of the bottom plate 21 enable the body 22 of the furniture element 2 to be rotated out of a room corner 4 shown schematically in FIGS. 1 to 3, consisting of a base 41 on which the bottom plate 21 of the furniture element 2 rests and two side walls 42, 43 which are aligned at right angles to one another here, wherein two of the side edges of the bottom plate 21 are positioned close to the side walls 42, 43, so that the furniture element 2 is positioned overall in the room corner.

The rotation and translation of the body 22 relative to the bottom plate 21 made possible by the raceways 28 in the bottom plate 21 and the raceways 27 in the bearing plate 26 and the rolling elements 51 arranged between them allows the furniture element 2 to be positioned in the corner of the room 4 in an initial position shown in FIG. 1. At the same time, the furniture element 2 is closed, i.e., covered by the side walls 24, which prevents access to objects stored in the furniture element 2 or protects them from dust or splashing water and gives an aesthetic impression of the furniture element 2.

By rotating the body 22 relative to the bottom plate 21 from this initial position, the furniture element 2 is opened, i.e., the side walls 24 of the body 22 are moved during the rotation into a position in which the side walls 24 are arranged directly opposite the side walls 42, 43, so that objects stored in the furniture element 2 are now freely accessible.

The design of the raceways 27, 28 makes it possible for the furniture element 2 to be positioned with its base 23 congruent with the bottom plate 21 again in the opening position shown in FIG. 3.

Only in the intermediate position shown in FIG. 2 is the base 23 of the furniture element 2 pivoted towards the bottom plate 21.

To further stabilize the translational and rotational movement of the body 22 relative to the bottom plate 21 and to fix the bottom plate 21 to the body 22, the bottom plate 21 has a slot 29 that is aligned in the direction of the axis of symmetry of the raceways 28 of the bottom plate 21. A guide sleeve 71 projects into this slot 29 and is fixed by a screw 72 projecting from the underside of the base 23 facing the bottom plate 21.

This screw 72 is centrally positioned in the base 23 of the body 22 of the furniture element 2.

Other fixing options are also conceivable, such as latching, clamping, pressing in, gluing, screwing or the like.

For use, the furniture element 2 positioned in the corner of the room 4 in FIG. 1 can thus also be moved out of the corner of the room 4 in direction A and essentially simultaneously rotated by turning about a position-variable vertical axis of rotation from the initial position shown in FIG. 1 in a direction of rotation $M_1$, $M_2$ into the open position shown in FIG. 3. In this case, the proportions of translation and rotation in the overall movement can vary over the course of the movement.

As shown in FIG. 5, in an alternative embodiment variant, a third raceway 28*c* is integrally formed in the bottom plate 21 and in the bearing plate 26 in addition to an outer raceway 28*a* and an inner raceway 28*b*.

Such a third raceway 28*c* enables further functions in the translational-rotational movement of the furniture element 2, 3.

The third raceway 28*c*, which in FIG. 5 follows a section of the outer raceway 28*a* radially further inwards from the origin of the rotational movement, serves here to limit the rotation of the furniture element.

In order to make this possible, the rolling element cage 5' shown in the middle of the three illustrations in FIG. 5, which here is approximately square in shape with slightly radially inwardly curved sides, is formed with recesses for rolling elements 51, which are arranged in the outer corners of the rolling element cage 5', for rolling elements 51 which can be moved in the outer raceway groove 28*a*. These rolling elements 51 are arranged on an outer circle $K_1$.

Receptacles for further rolling elements 51 are integrally formed approximately centrally in the sides of the rolling element cage 5', which rolling elements 51 are movable in the inner raceway groove 28*b*. These rolling elements 51 are arranged on an inner circle $K_2$.

The rolling element 51 to be guided in the third raceway 28*c* is provided radially inside one of the rolling elements 51 arranged in the corners of the rolling element cage 5'. This rolling element 51 is arranged on a central circle $K_3$.

The axes of symmetry $SK_2$, of the rolling element arrangement 51 on the circle $K_1$ are inclined by 45° to the axes of symmetry $SK_2$ of the rolling element arrangement 51 on the circle $K_2$.

As can be seen in the lower representation of FIG. 5, inner raceway grooves 27*a* and outer raceway grooves 27*b* are also integrally formed in the bearing plate 26, as well as a further third raceway groove 27*c*, which is also formed relative to a portion of one of the outer raceway grooves 27*b* radially further inward toward the origin of rotation U.

As can further be seen in this figure, the raceways 27*a* and 27*b* are shaped to be symmetrical with respect to both an axis of symmetry $S_1$, which is vertical here, and a horizontal axis of symmetry $S_2$.

Figure 1:
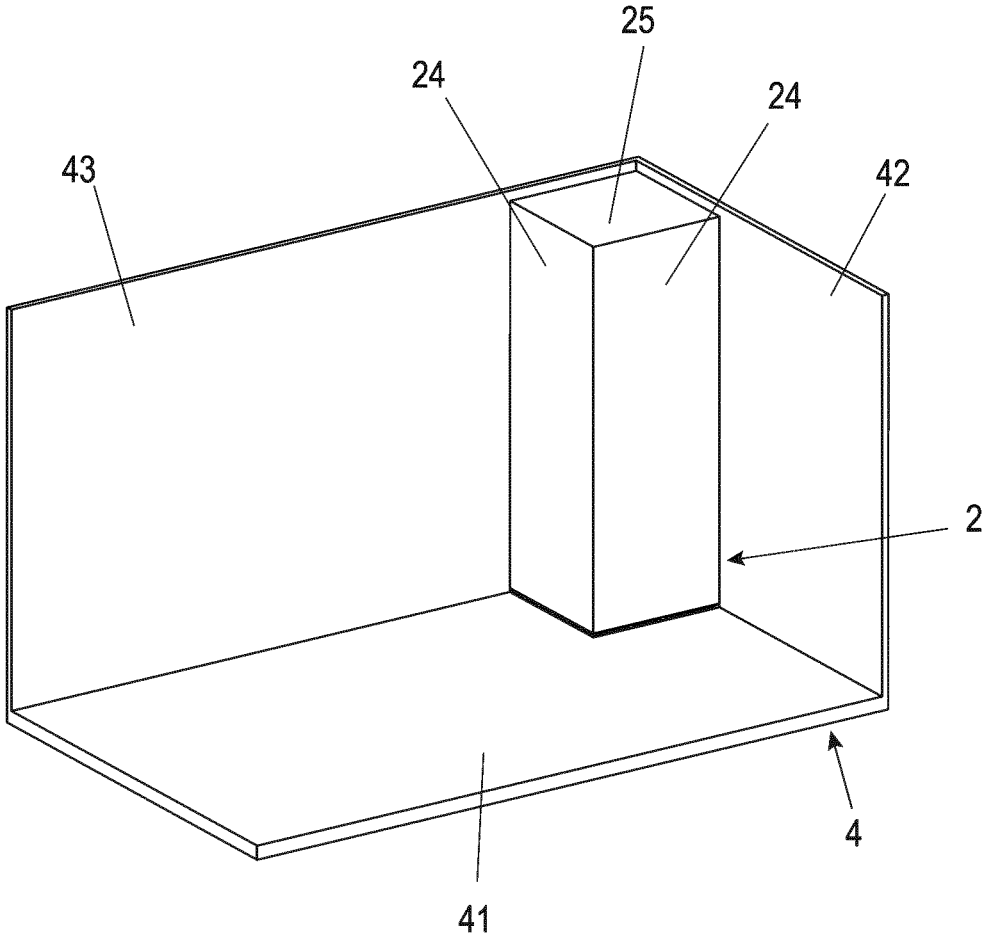
Figure 2:
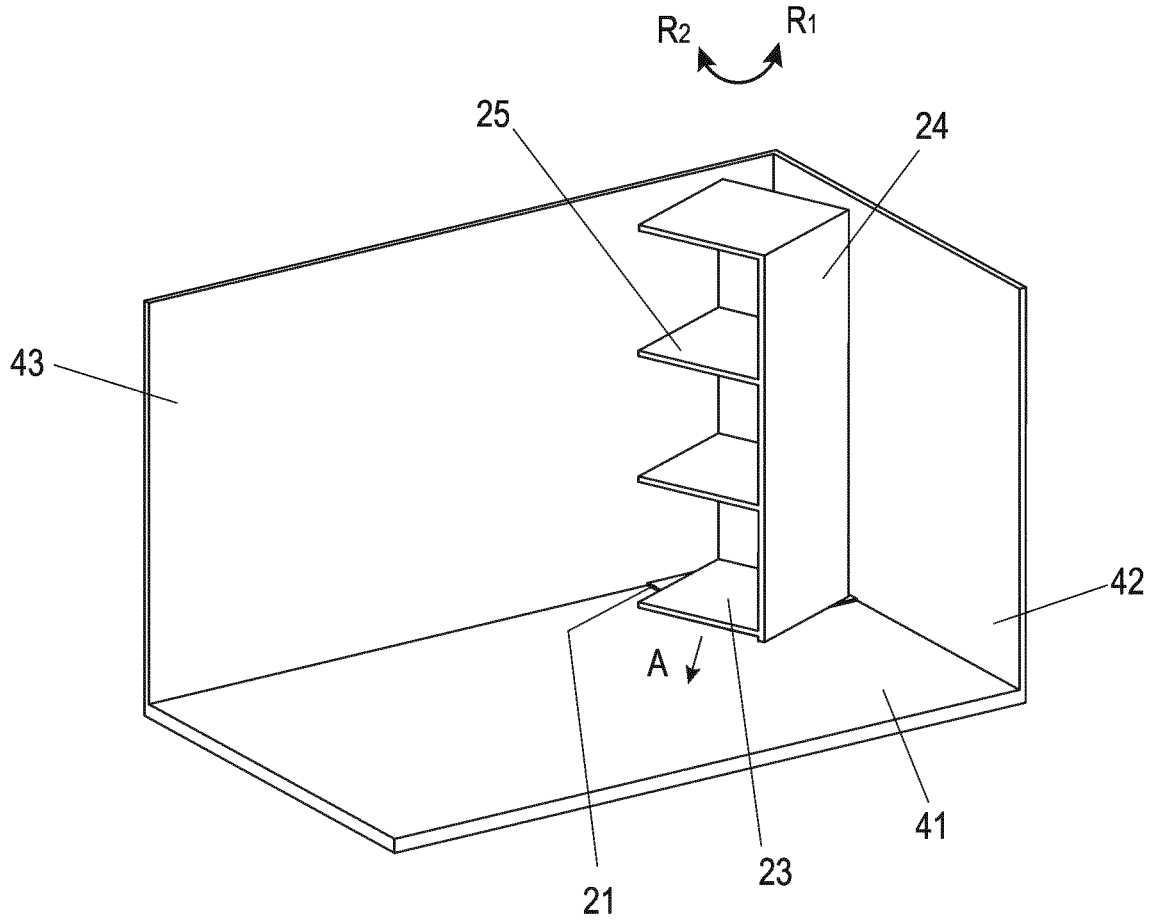
Figure 3:
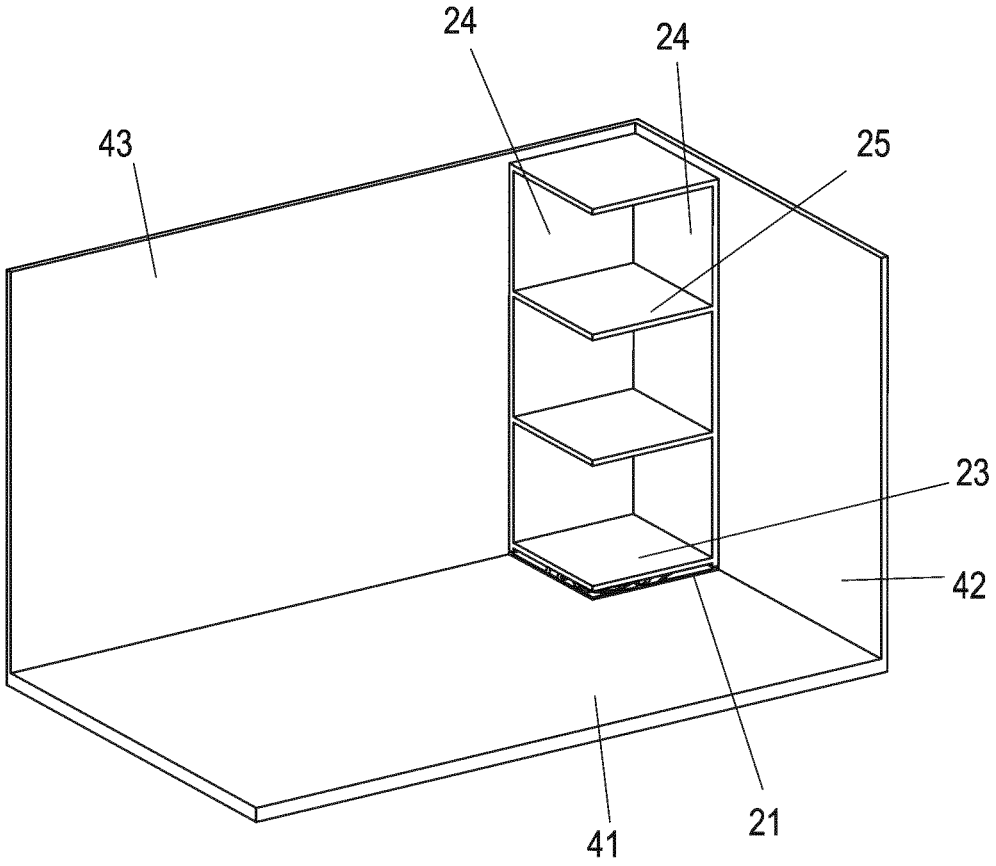
Figure 4:
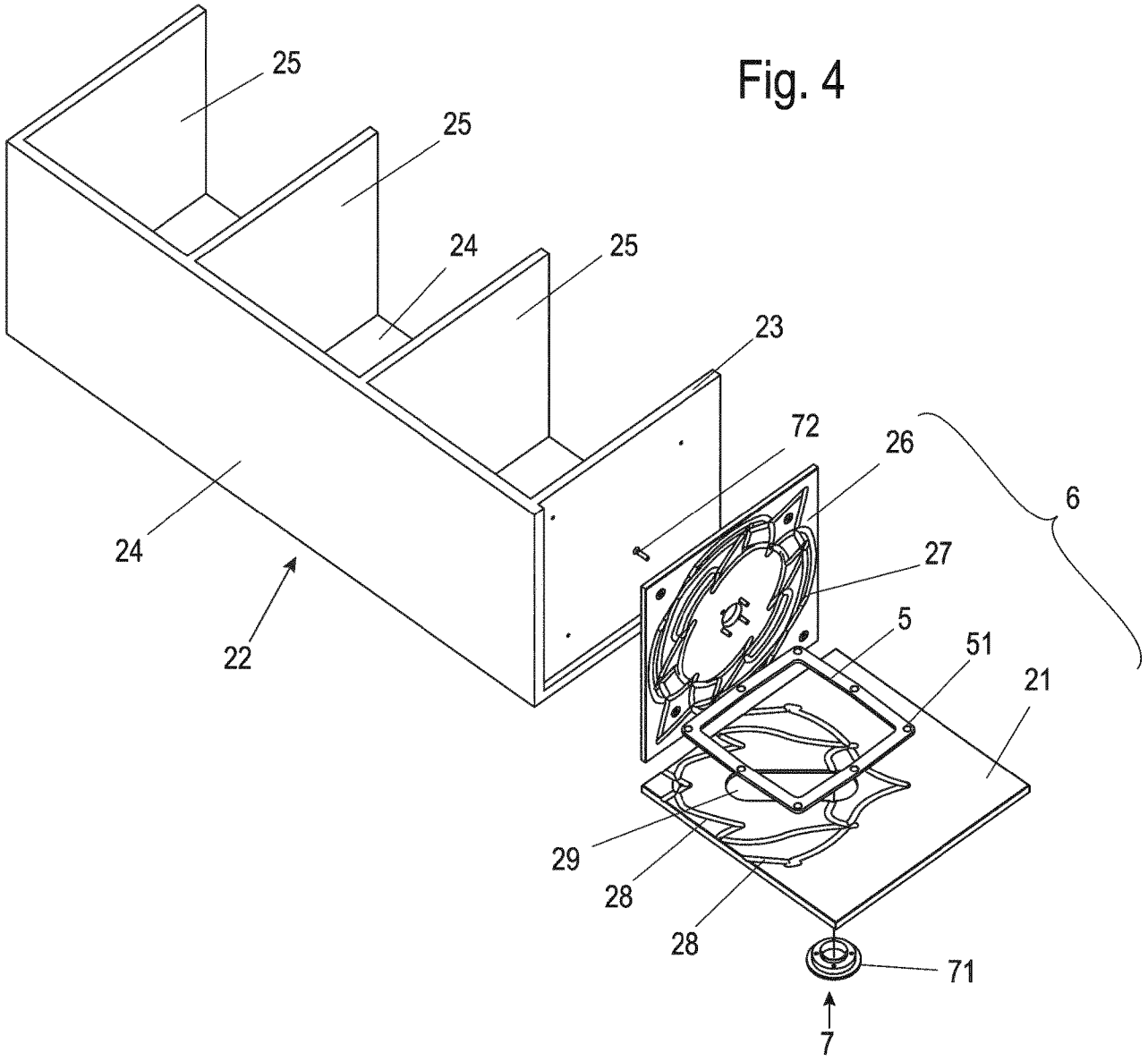
Figure 5:
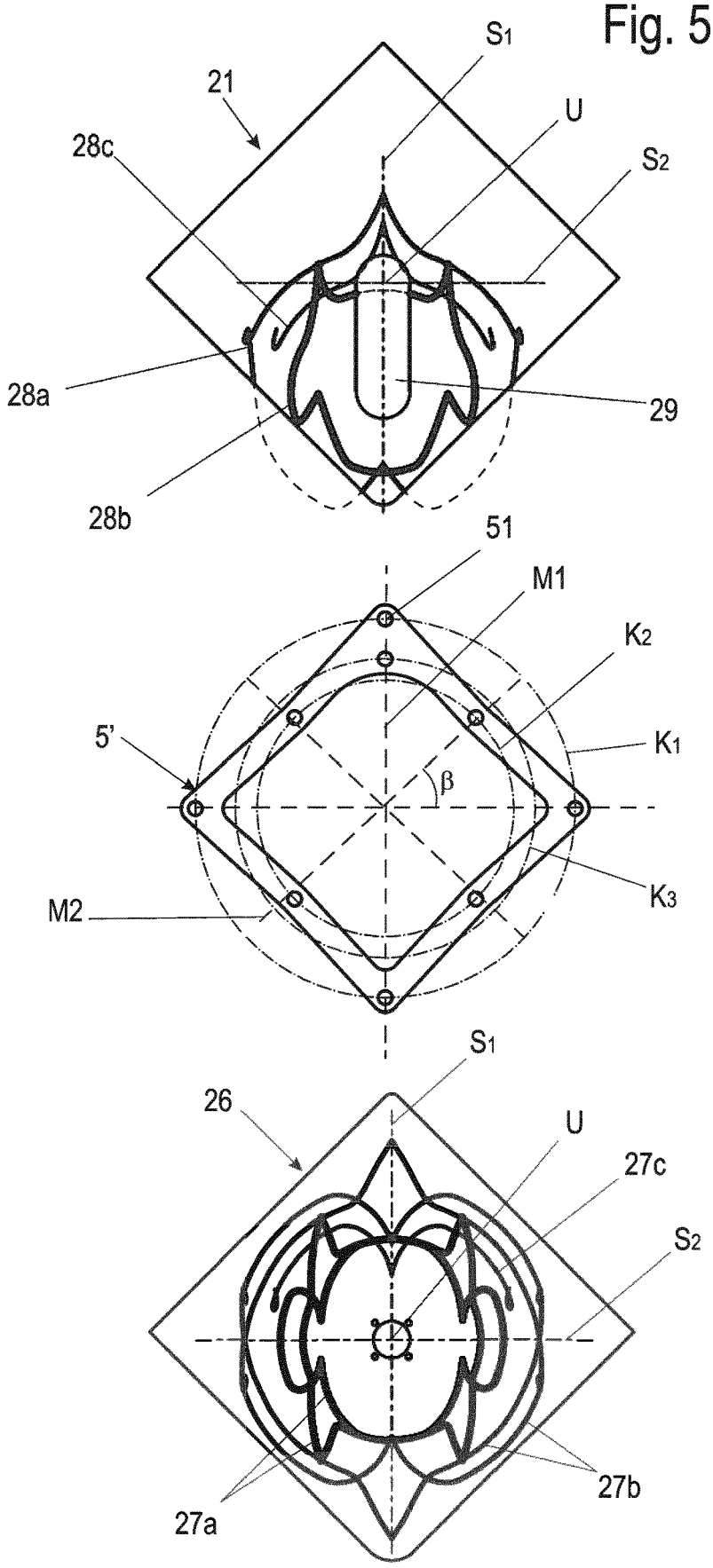
Figure 6:
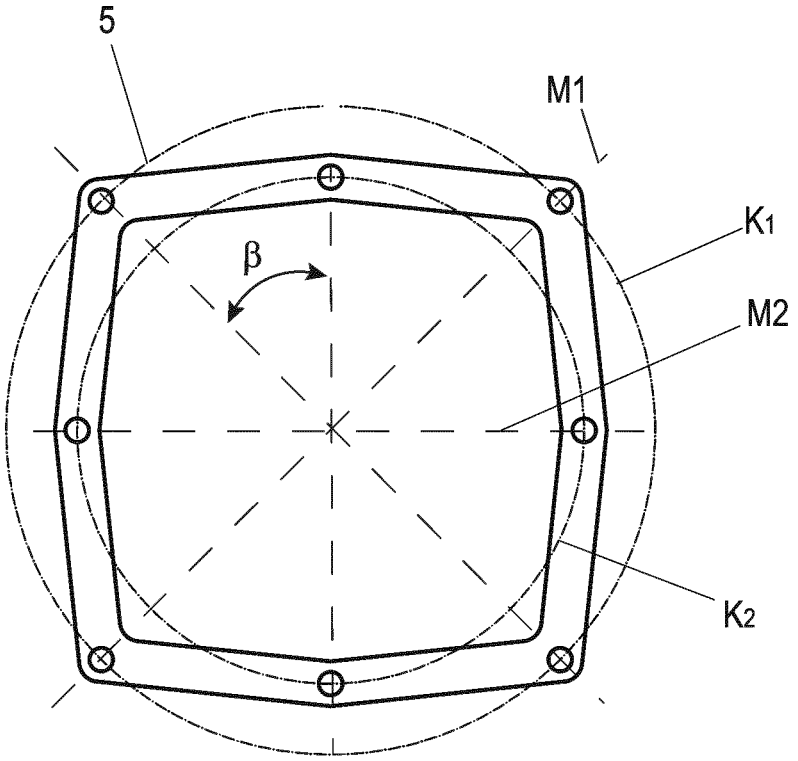
FIG. 6 shows further embodiment variants for rolling element cages 5, 5" with rolling element receptacles arranged in such a way so as to be disposed accordingly on an outer circle $K_1$ and on an inner circle $K_2$.
Figure 6:
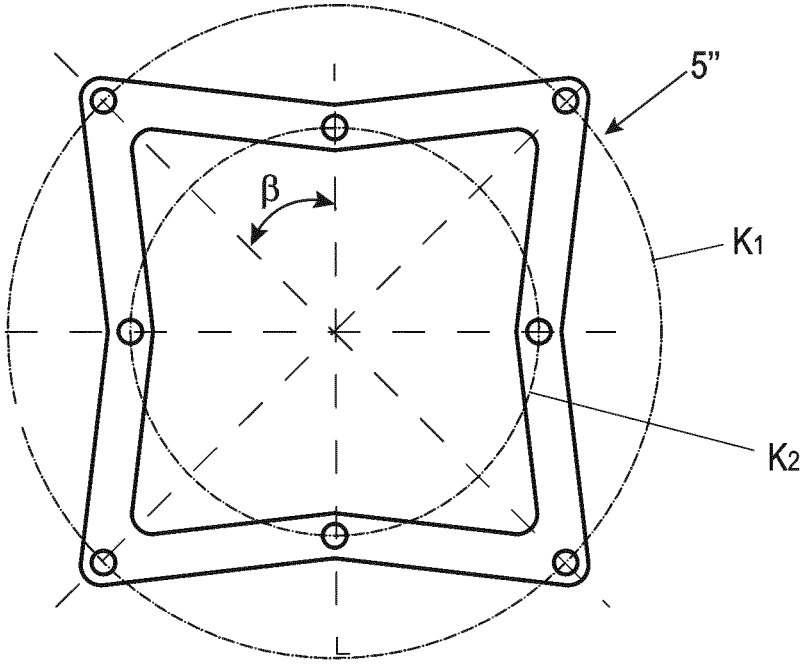
Figure 7:
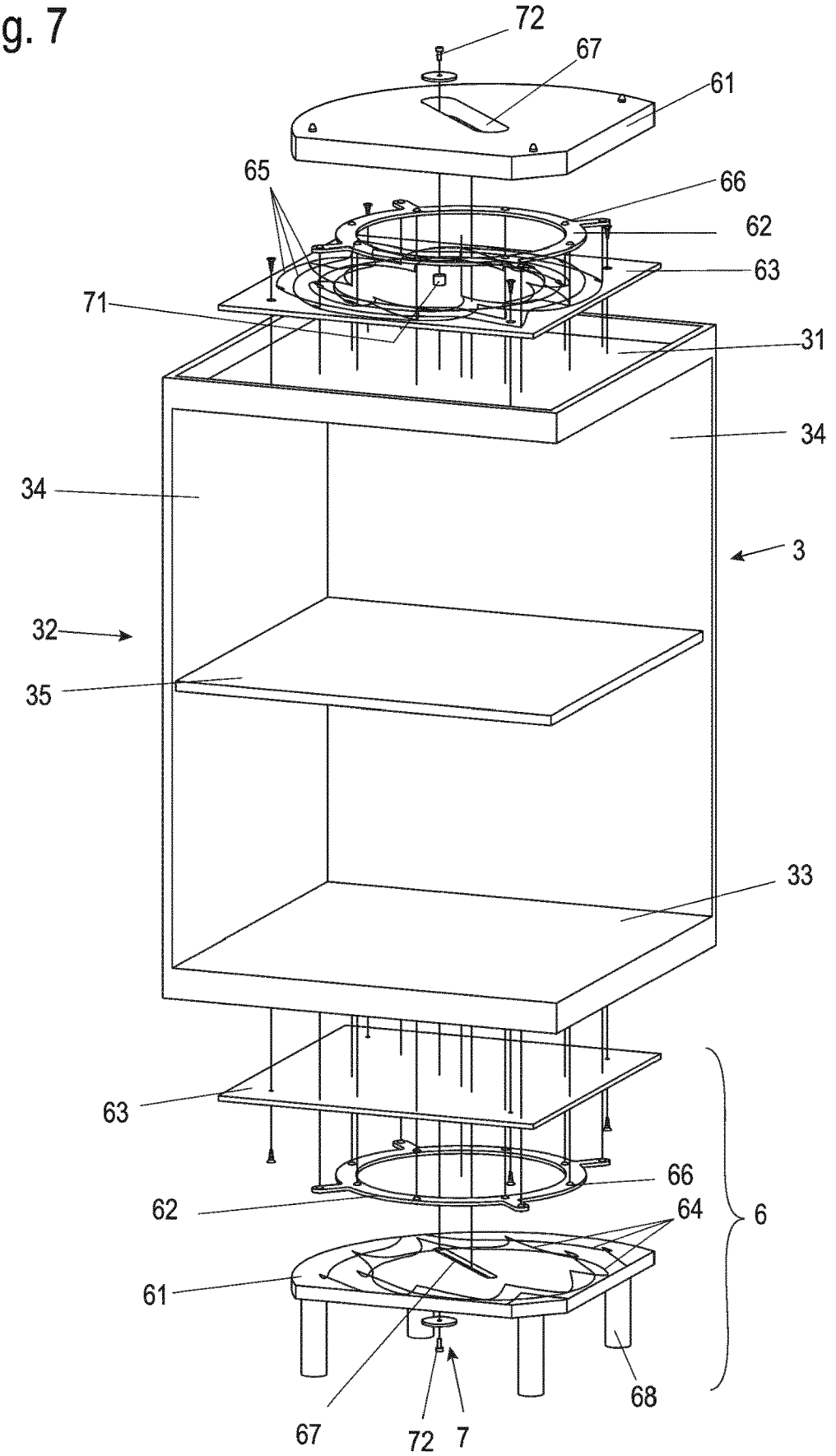
FIGS. 7 to 15 show a further embodiment variant of a furniture element 3 according to the invention.

As shown in the exploded view in FIG. 7, in contrast to the embodiment variant of the furniture element described on the basis of FIGS. 1 to 4, a translational-rotational bearing 6 is arranged in each case both below a base 33 of the body 32 of the furniture element 3 and above a cover plate 31 of the furniture body 32 of the furniture element 3, wherein the upper bearing 6 is arranged with the bottom plate 61 facing upwards.

Both the base 33 and the cover plate 31 form a cavity in this case with an upper edge and a lower edge of the furniture body 32, in which at least part of the bearing 6 is accommodated.

The essential structure of the two bearings 6 is essentially the same as that described with reference to FIGS. 1 to 4. In this exemplary embodiment, too, there is a fixing device 7 having a screw 72 and a guide sleeve 71 and a rolling element cage 62 having rolling elements 66.

In this case, the bottom plate 61 corresponds to the bottom plate 21, and the bearing plate 63 corresponds to the bearing plate 26. In the application of the furniture element 3 shown in FIG. 7, this element can preferably be used in a piece of furniture 8 as shown in FIGS. 8 to 15.

The piece of furniture 8 shown in FIGS. 8 to 15 is here, for example, kitchen furniture in the form of a cooking island. However, other places of use for such a furniture element 3 are also conceivable.

In order to adapt the bottom plate 61 of the translational-rotational bearing 6, which is fixed below the base 33 of the furniture element 3, to the height of the bases of the other components of the piece of furniture 8, feet 68 are attached to a lower side of the bottom plate 61 facing away from the raceways 64. These feet 68 can be designed to be adjustable.

The bearing plate 63 is preferably attached to the underside of the base 33 of the body 32 of the furniture element 3 facing the bottom plate 61. It would also be conceivable here to work the raceways 65 directly into the underside of the base 33 instead of the bearing plate 63.

Figure 8:
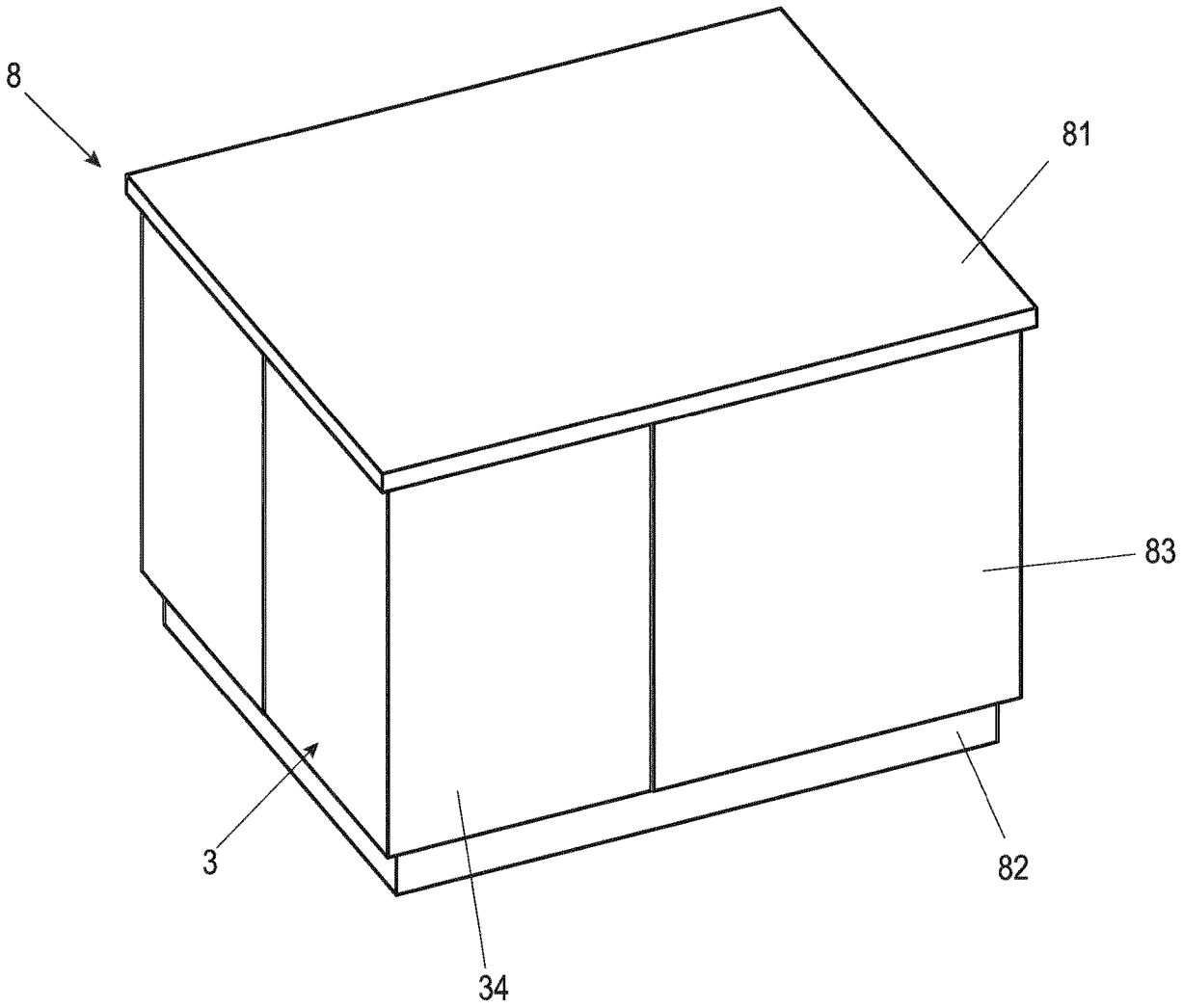

FIG. 8 shows the piece of furniture 8 in the form of an island unit having a cover plate 81, several side walls 83 and a base panel 82 with a furniture element 3 arranged in a corner in the closed state of the furniture element 3. The feet 68 are arranged behind the base panel 82.

Figure 9:
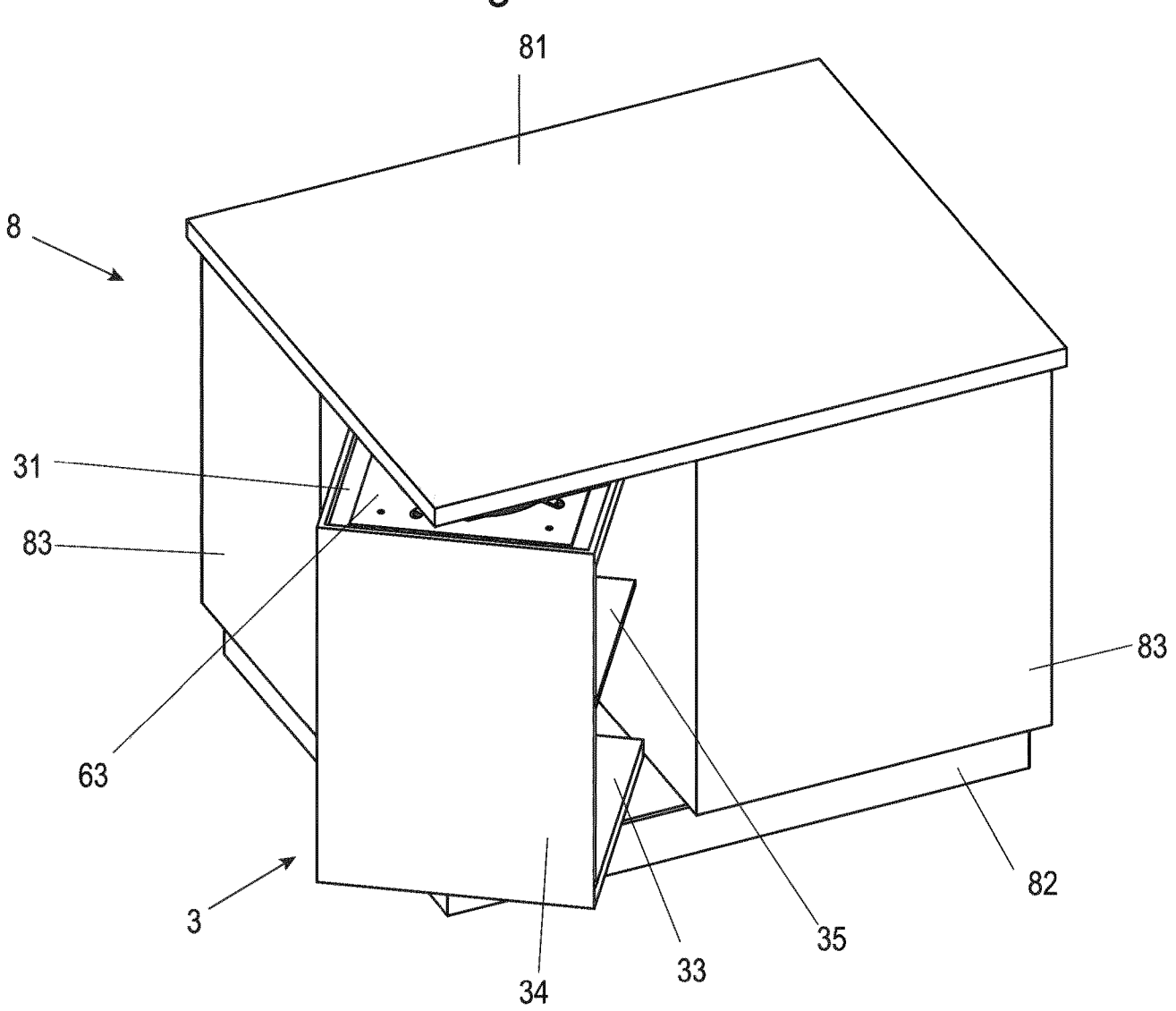
Figure 10:
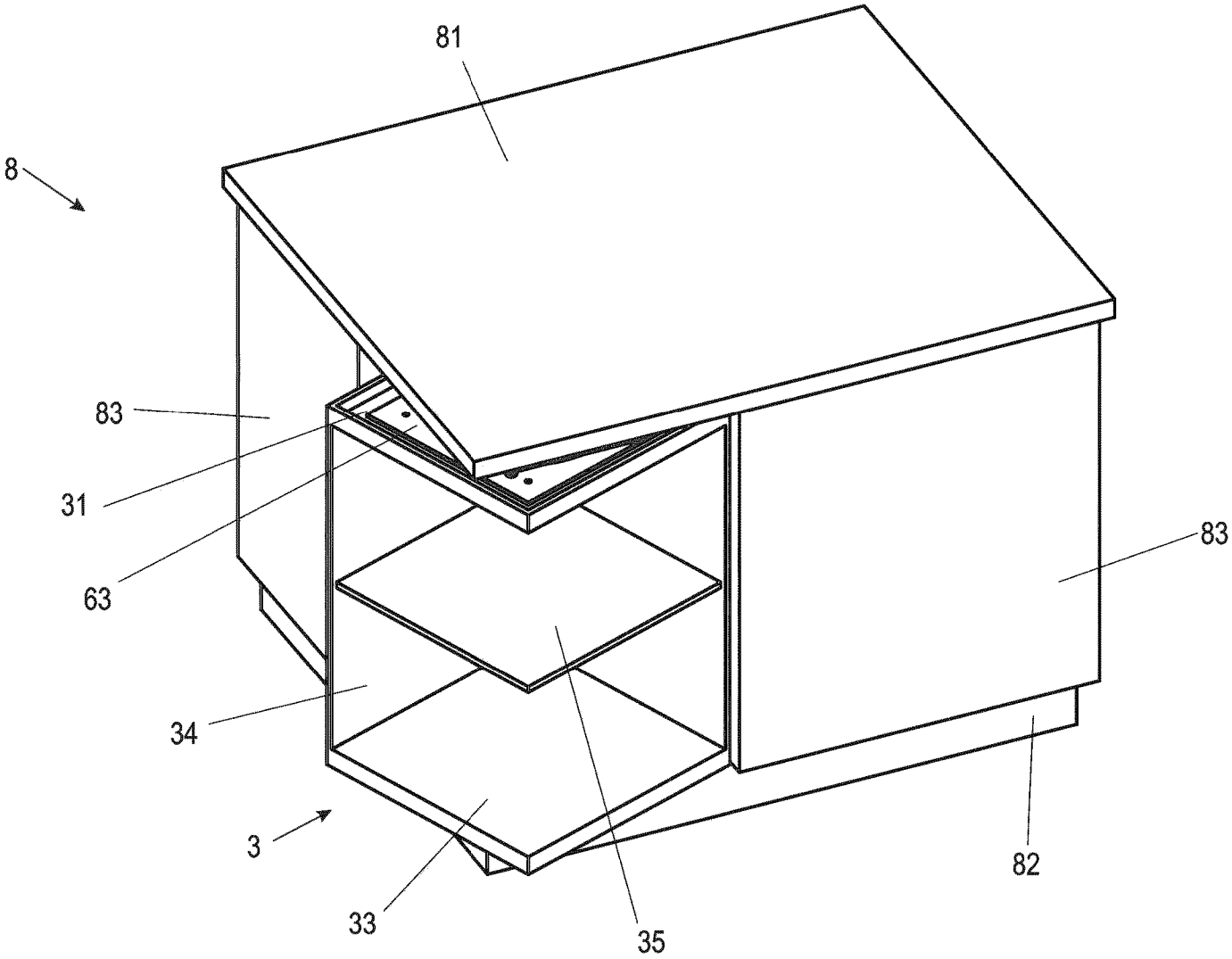
Figure 11:
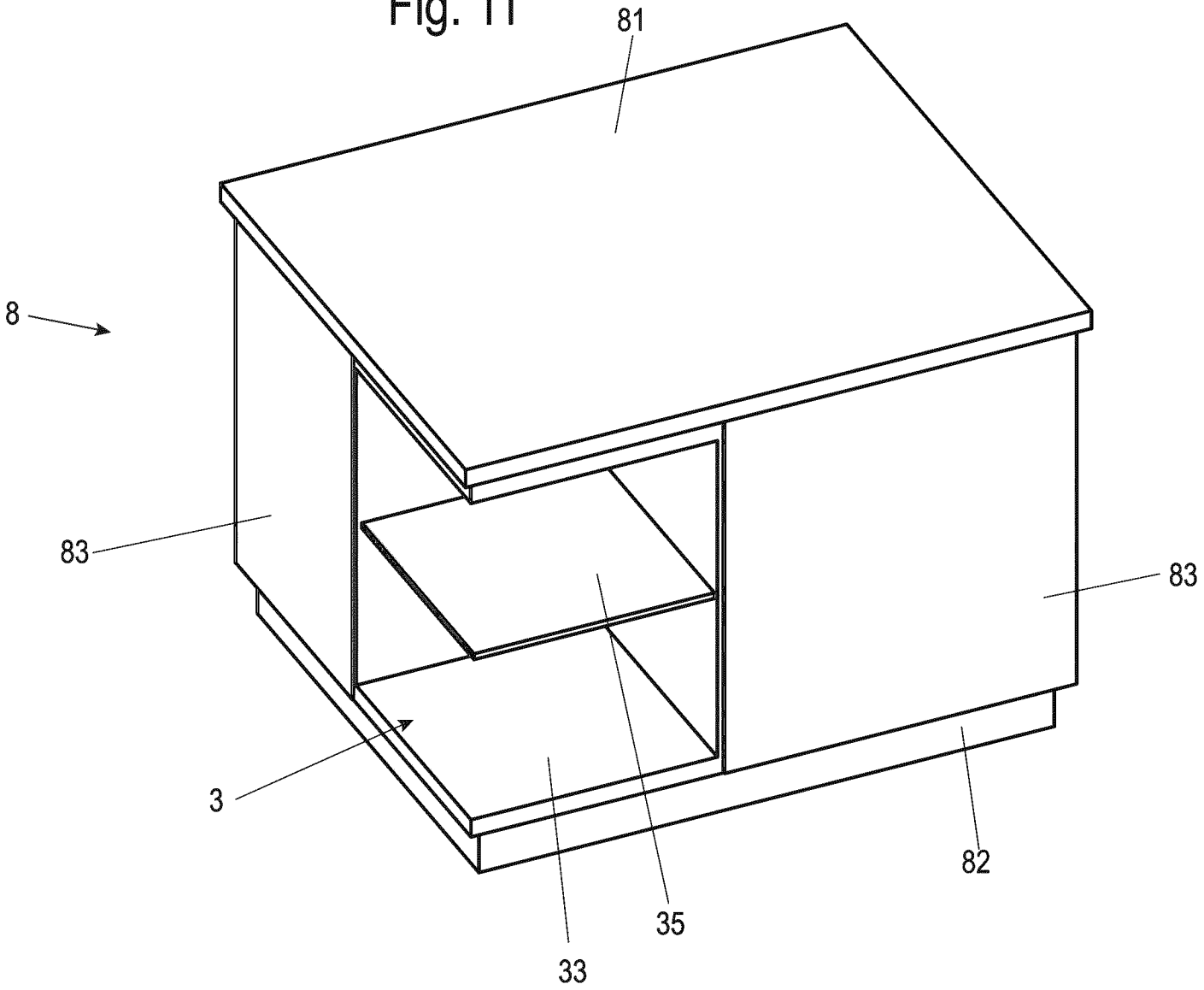

FIG. 9 shows the furniture element 3 in a slightly open position, FIG. 10 shows the furniture element 3 in an almost fully rotated open position and FIG. 11 shows the piece of furniture 8 with the furniture element 3 fully open.

Figure 12:
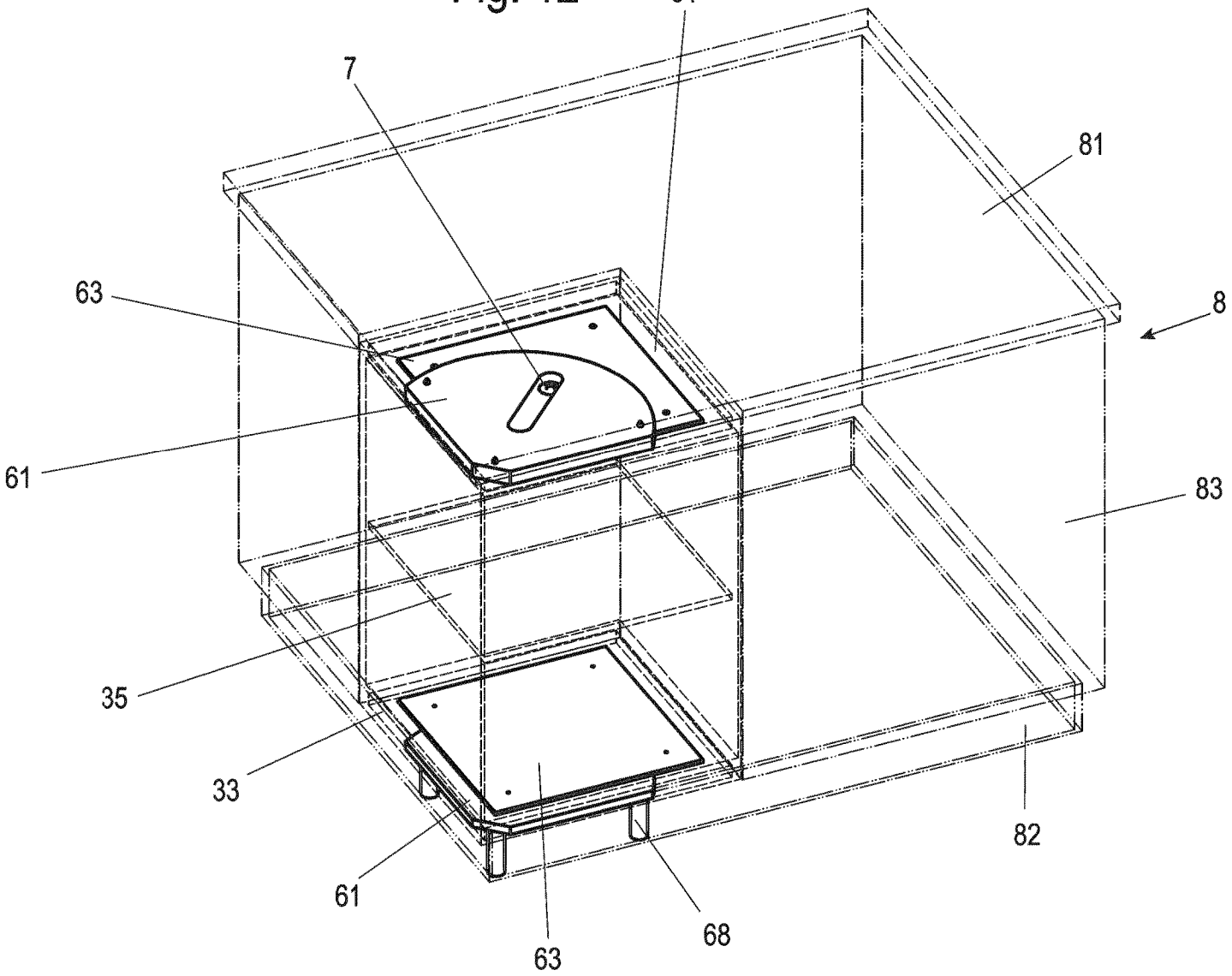

In FIG. 12, the piece of furniture 8 is still shown with dashed lines, to show the furniture element 3 installed in the piece of furniture 8 below the cover plate 81.

Figure 13:
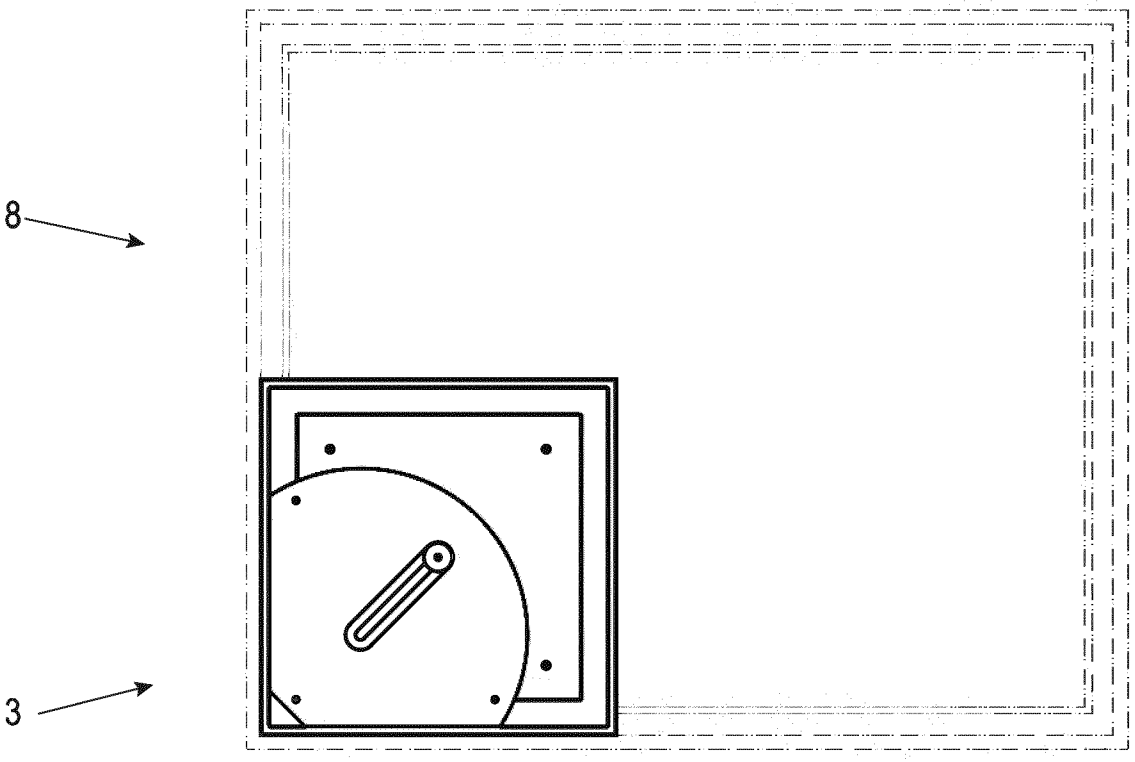
Figure 14:
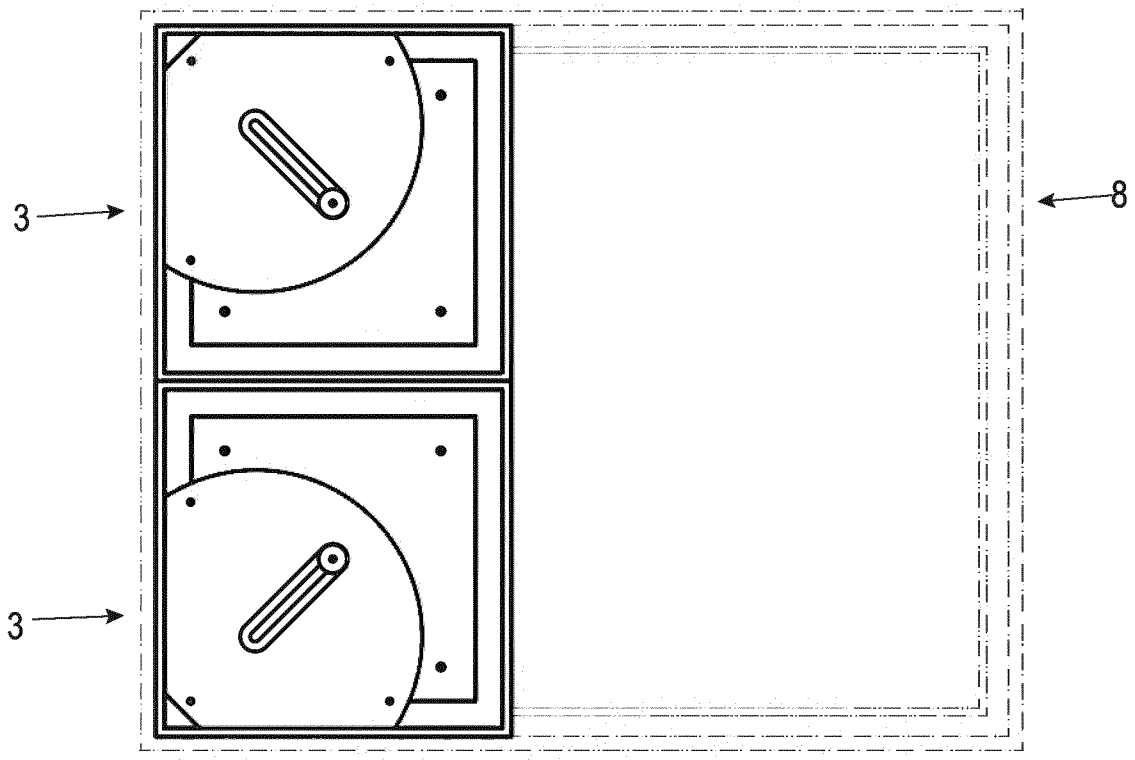
Figure 15:
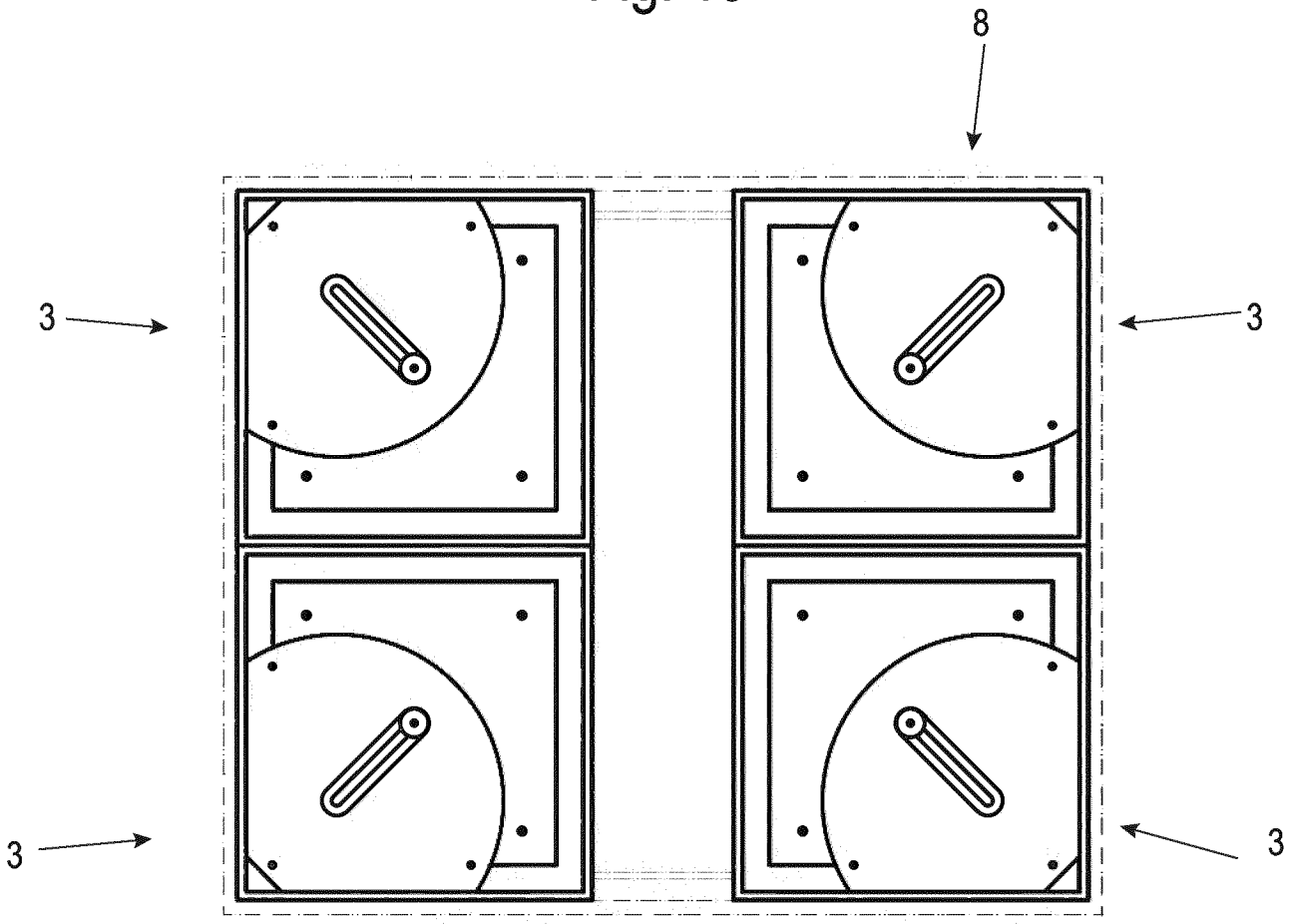

FIGS. 13 to 15 show possible embodiment variants of such a piece of furniture with one furniture element 3 (FIG. 13), two such furniture elements 3 (FIG. 14) and four such furniture elements 3 (FIG. 15). When arranging a plurality of furniture elements 3, preferably only one common cover plate 81 is used.

FIGS. 16 to 22 show a further embodiment variant of a piece of furniture 10 according to the invention with a furniture element 12 which is movable in translation and rotation relative to a furniture body 11 standing fixedly or frictionally on a floor of a room.

The piece of furniture 10 is designed, as shown in particular in FIGS. 16 and 20 to 22, as desk furniture or kitchen island or kitchen worktable or the like, with the furniture body 11 fixedly placed on the room floor and the furniture element 12 which can be moved in translation and rotation relative to the furniture body 11.

Figure 17:
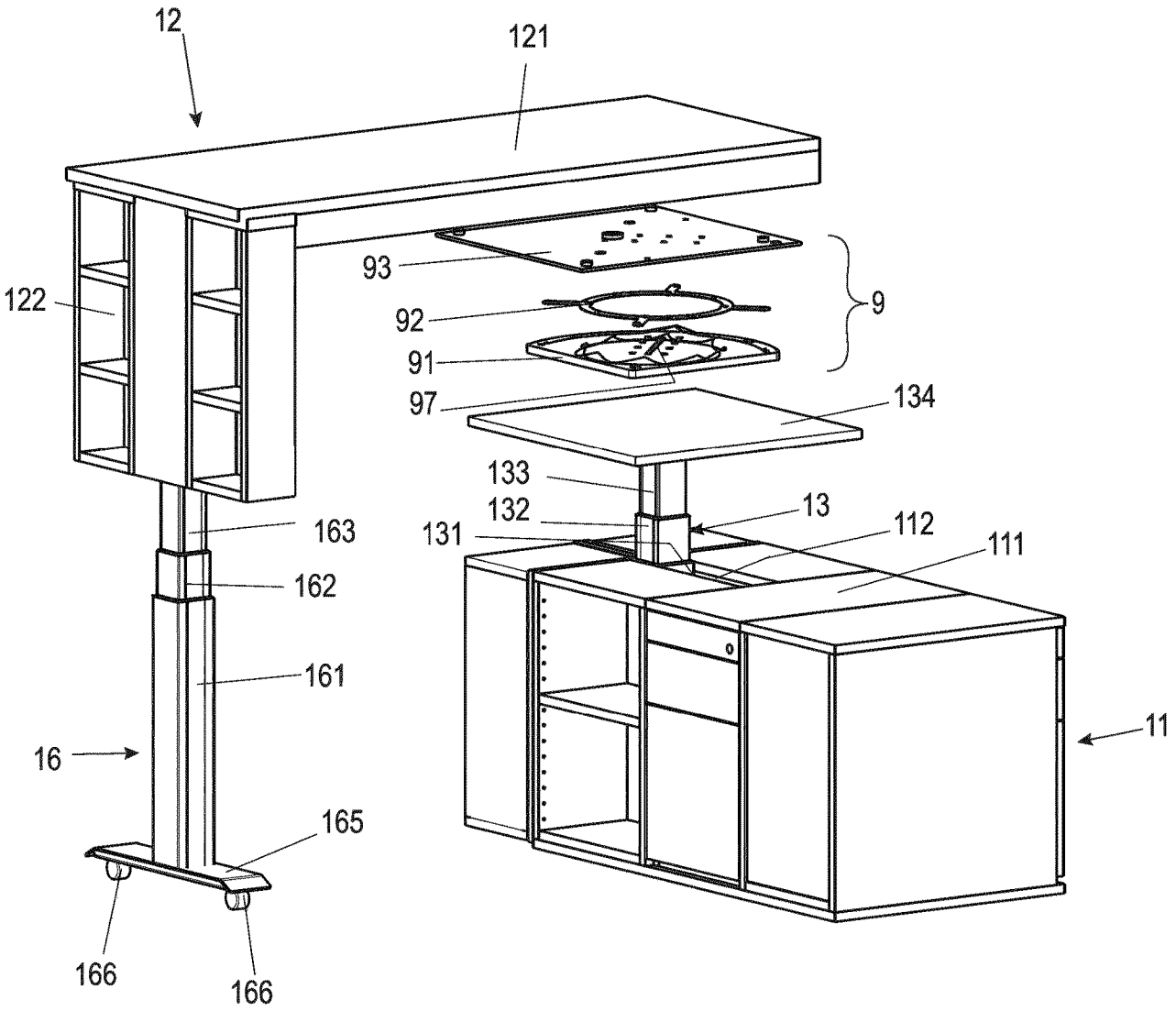
Figure 21:
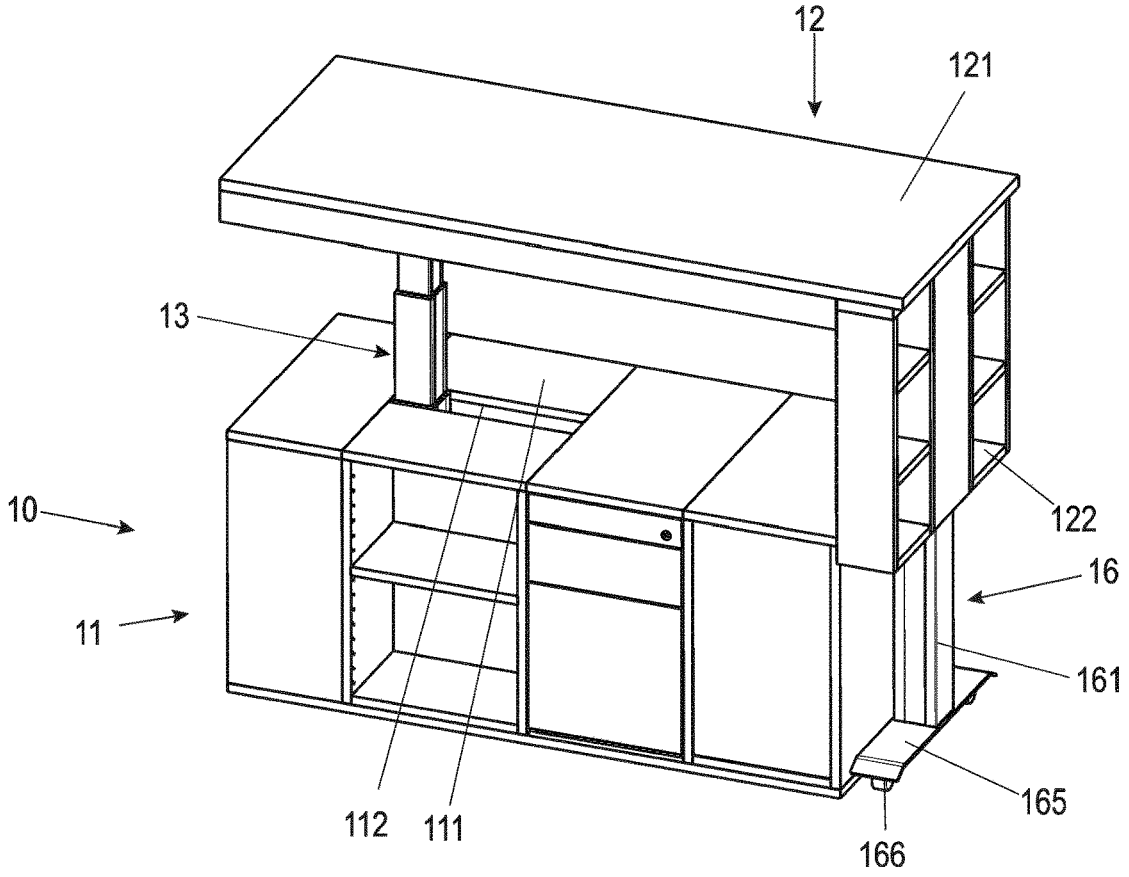
Figure 22:
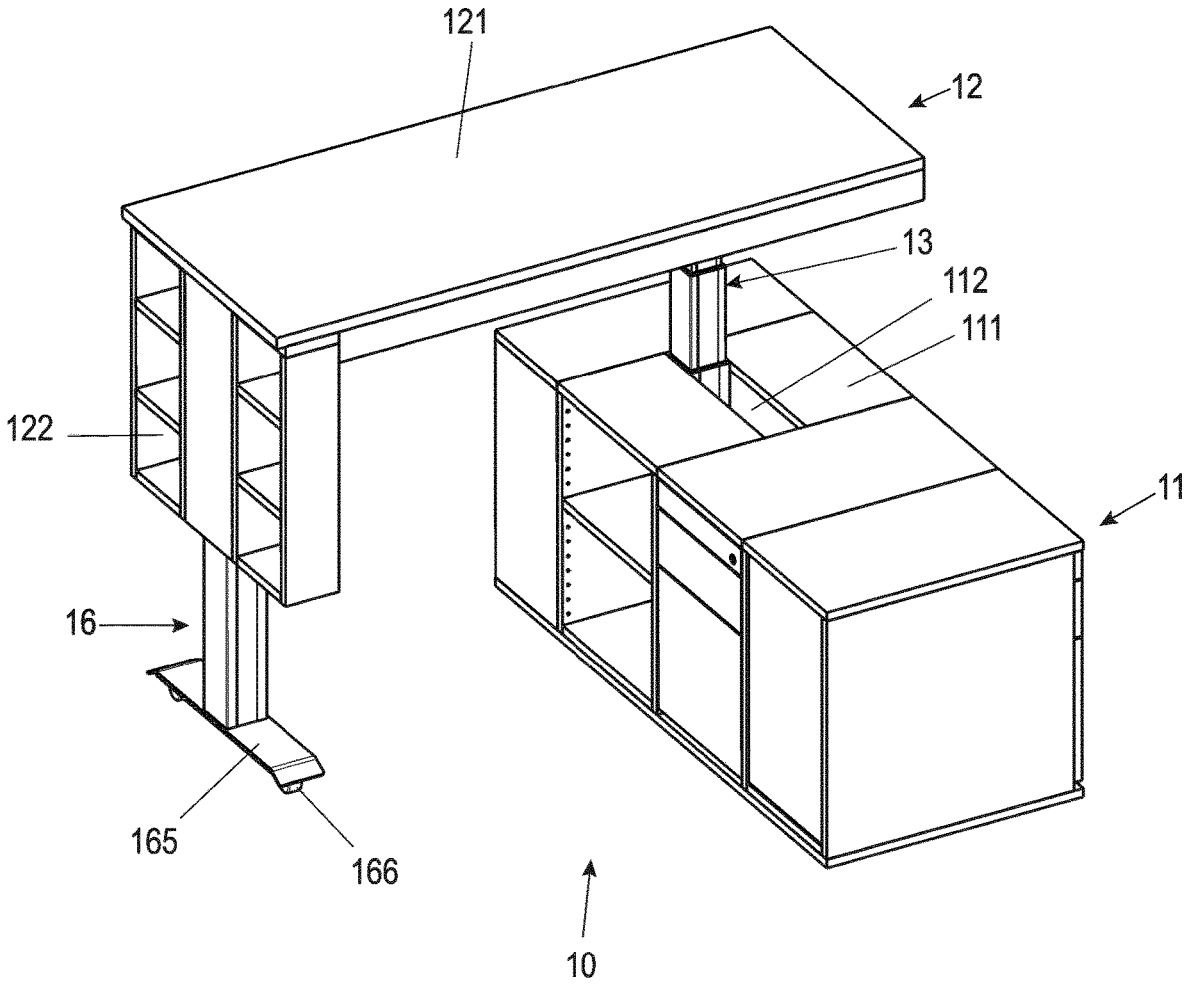

As shown in FIGS. 17, 21 and 22, the furniture body 11 includes a receptacle 112 in a central region of a work surface 111 for accommodating a first lifting device 13.

The lifting device 13, designed here as a telescopic lifting device, is accommodated in the receptacle 112 of the furniture body 11, wherein telescopic elements 131, 132, 133 are movable upwards out of the receptacle 112.

A support plate 134 is mounted on the uppermost of the telescopic elements 133. A bottom plate 91 of a further embodiment variant of a translational-rotational bearing 9 is mounted on this support plate 134.

As shown by way of example in FIG. 17, the furniture element 12 has a body 121 with a worktop, to the base of which the bearing plate 93 of the translational-rotational bearing 9 is attached.

A side part 122 is arranged, in particular fastened, at one end of the body 121, which side part 122 has a central receptacle for accommodating a second lifting device 16.

The structure of the second lifting device 16 preferably corresponds to that of the first lifting device 13, i.e., it also has a first, a second and a third telescopic element 161, 162, 163.

A foot 165 with at least two rolling elements 166 is arranged on the lowest, first telescopic element 161 of the lifting device 16.

The side part 122 thus serves as a second support leg of the furniture element 12 for the lifting device 16 arranged thereon.

The furniture element 12 is thus supported on the one hand by the side part 122 and the second lifting device 16 arranged thereon and via the first lifting device 13.

The lifting device 13 thereby supports the body 121 of the furniture element 12 via the translational-rotational bearing 9 accommodated therebetween.

Figure 16:
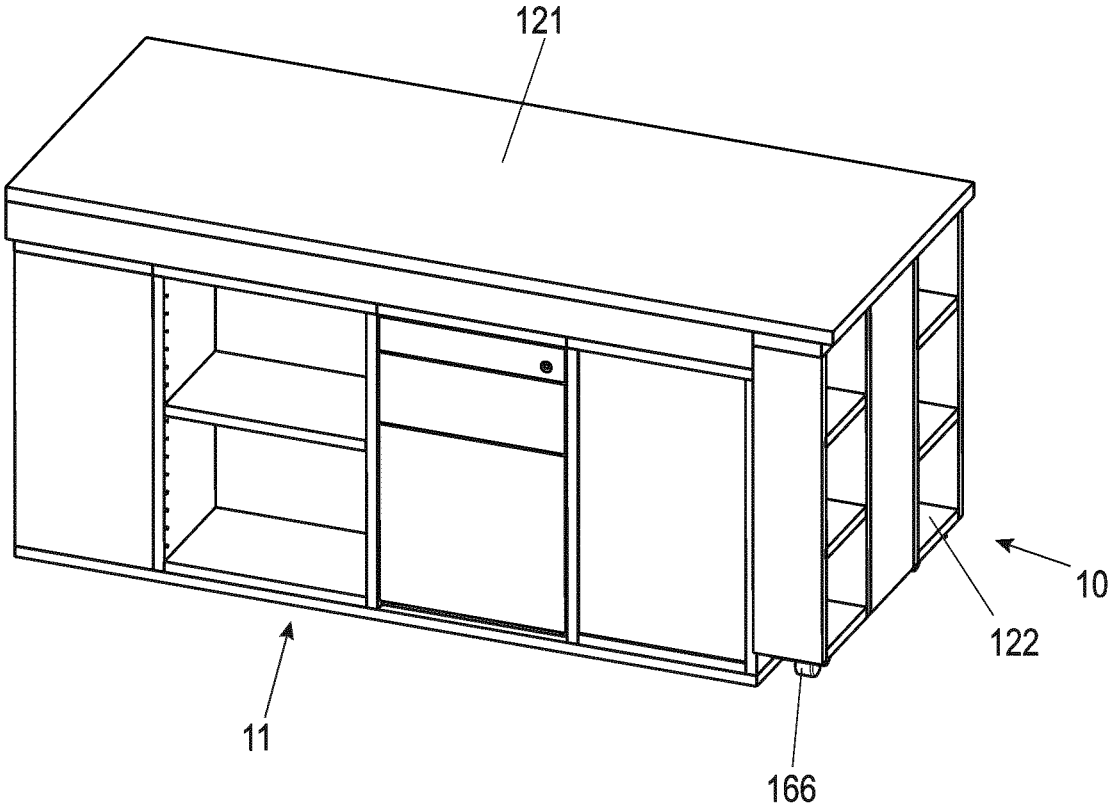
Figure 20:
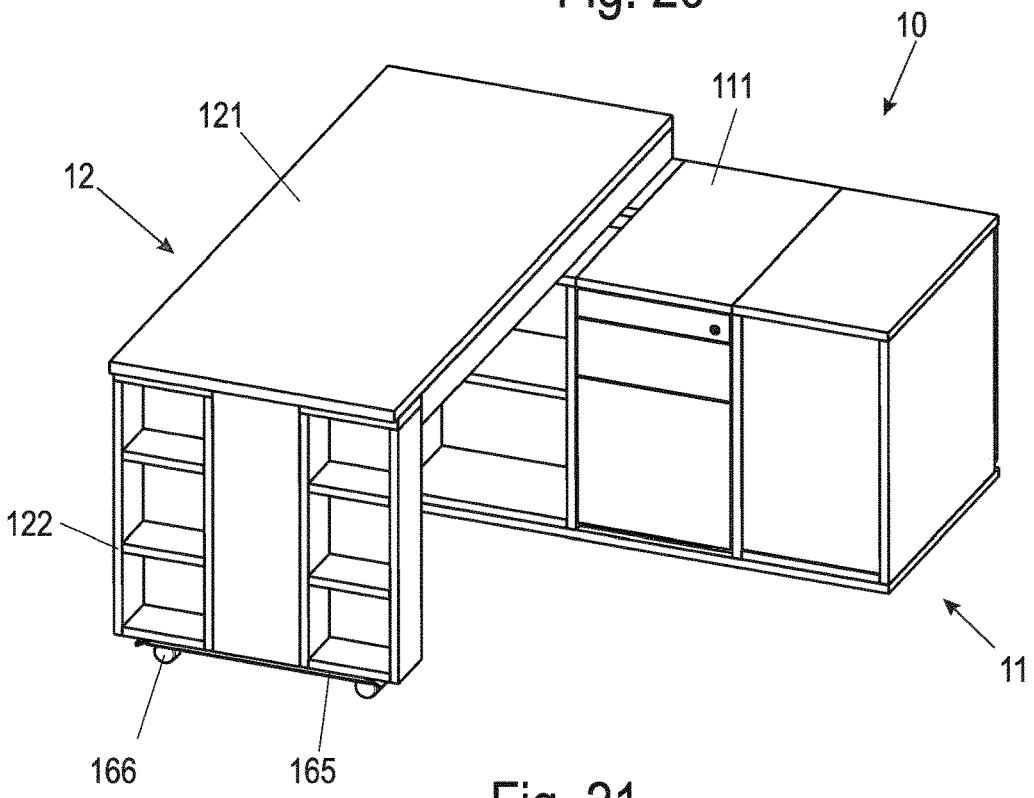

The furniture element 12 can thus be moved from an initial position shown in FIG. 16, in which the furniture element 12 covers the furniture body 11, here completely, by synchronous actuation of the lifting devices 13, 16, with which the furniture element 12 can be lifted relative to the furniture body 11, to the open position shown in FIG. 20.

In the open position, the upper side of the body 121 of the furniture element 12, which serves here as a work surface, is aligned perpendicularly to the work surface 111 of the furniture body 11. Other opening positions are also conceivable. Depending on the orientation and embodiment of the translational-rotational bearing 9, the furniture element 12 can be moved through a larger or smaller angle, for example 180°.

The arrangement of the translational-rotational bearing 9 on the support plate 134 of the first lifting device 13 makes it possible to move the furniture element 12 from the position shown in FIG. 16 to the position shown in FIG. 20 when the furniture body 11 is located in a corner of the room, without the furniture element 12 protruding over a rear edge of the furniture body 11 during the movement. This is very advantageous when the furniture body 11 is arranged against a wall or in a corner.

Figure 18:
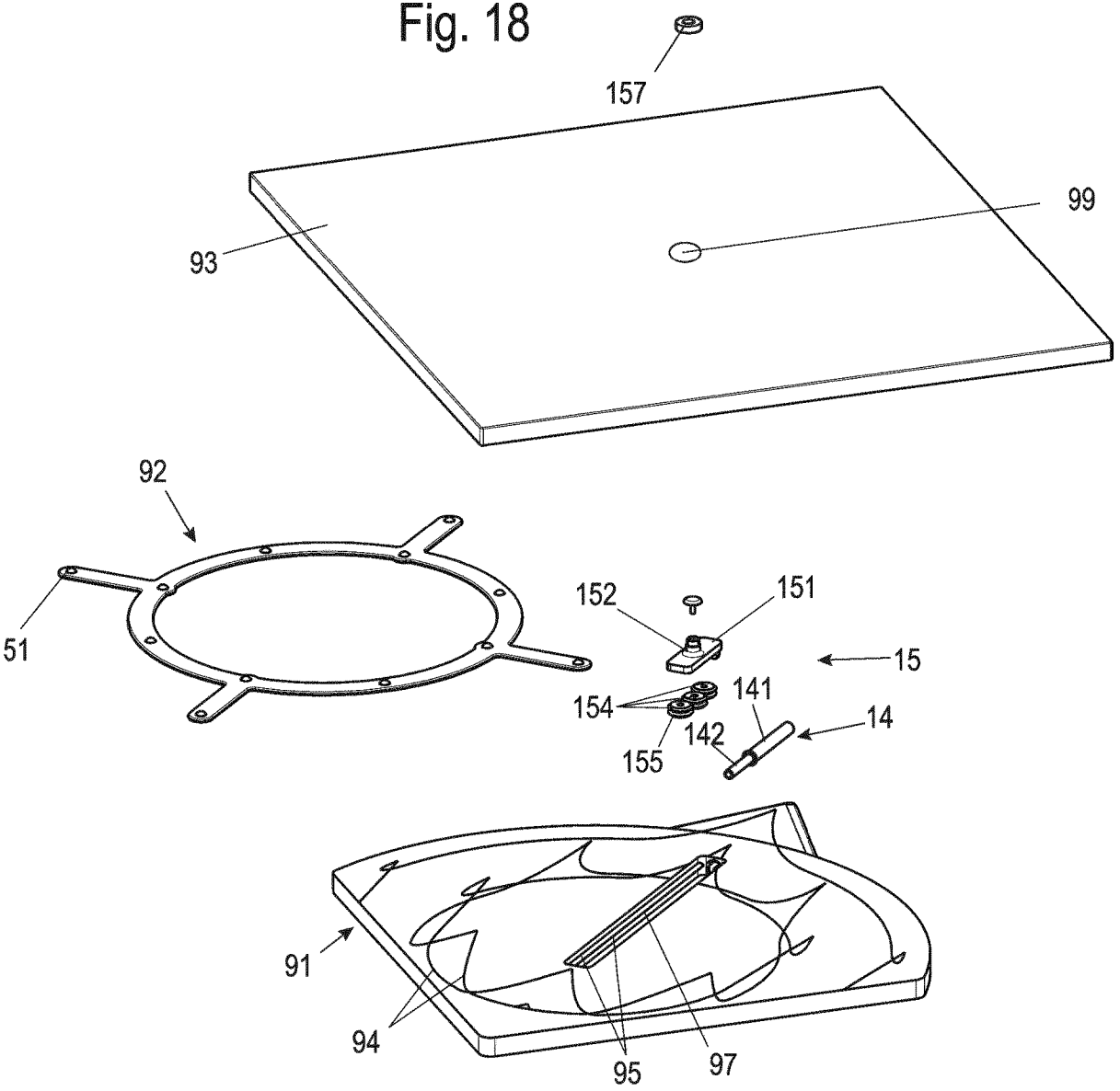
Figure 19:
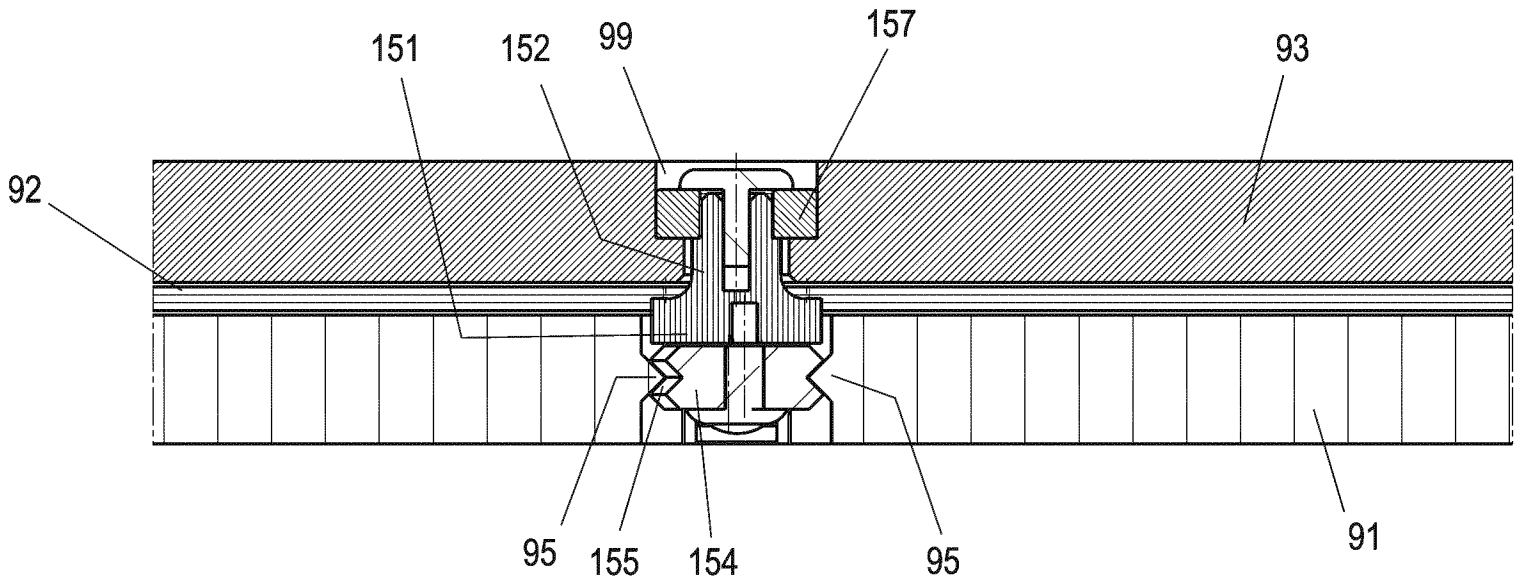

The translational-rotational bearing 9 shown in FIG. 17 is shown in detail in FIGS. 18 and 19.

As shown in FIGS. 18 and 19, the bottom plate 91 also has raceways 94 on its bearing surface facing the bearing plate 93 for guiding rolling elements 51, here in the form of balls.

The rolling elements 51 are also captively accommodated in a rolling element cage 92. As in the embodiment variant shown in FIG. 7, the rolling element cage 92 is circular with several arms extending radially outward.

A guide channel 97 is also provided here centrally and diagonally to two side edges of the bottom plate 91 which are aligned at right angles to each other.

A guide carriage 151 is displaceably mounted in this guide channel 97.

The guide carriage 151 as part of a fixing device 15 comprises, on its upper side facing the bearing plate 93 or the body 121 of the furniture element 12, a bearing neck 152 projecting into an opening 99 in the bearing plate 93, which is preferably integrally formed on the upper side of the guide carriage 151.

The bearing neck 152 serves as an axis for a rolling bearing ring 157, in particular a ball bearing ring, inserted into the opening 99 of the bearing plate 93, which is preferably in the form of a bore, by means of which low-friction rotational movement of the bearing plate 93 relative to the guide carriage 151 and thus relative to the bottom plate 91 is made possible.

A roller bearing having at least two rollers 154 arranged one behind the other in the longitudinal direction of the guide channel 97 is arranged, in particular fastened, on the underside of the guide carriage 151 facing away from the bearing plate 93.

Each of these rollers 154 has a circumferential V-shaped groove 155 into which V-shaped webs 95, which protrude from opposite side walls of the guide channel 97, form running faces for the rollers 154.

The V-shaped grooves 155 of the rollers 154, which are guided along the V-shaped webs 95 in the guide channel 97, produce an extremely stable and constant sequence of the translational-rotational movement of the furniture element 12.

In addition, a push-to-move mechanism in the form of an ejector element 14 is shown in FIG. 18, which consists of a force accumulator 141 and a plunger 142 and is arranged in the guide channel 97 in order to eject the furniture element 12 after unlocking in a direction of movement.

The use of such a push-to-move mechanism makes it possible in particular to design the furniture element without an actuating handle and to initiate the opening movement of the furniture element by pushing it in against the intended opening direction. The use of an ejection mechanism that can be activated in another way is also conceivable.

Alternatively, the piece of furniture can also be designed as desk furniture or kitchen island or kitchen worktable or the like, without an additional second lifting device on the furniture element 12. In this case, the furniture part which is movable in a translation-rotational manner is supported only by the first lifting device arranged on the stationary furniture body.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

2 Furniture element
21 Bottom plate
22 Body
23 Base
24 Side wall
25 Shelf
26 Bearing plate
27, 27*a*. 27*b*, 27*c* Raceway
28, 28*a*, 28*b*, 28*c* Raceway
29 Slot

3 Furniture element
31 Cover plate
32 Body
33 Base
34 Side wall
35 Shelf
4 Room corner
41 Base
42 First side wall
43 Second side wall
5, 5', 5" Rolling element cage
51 Rolling elements
6 Translational-rotational bearing, bearing
61 Bottom plate
62 Rolling element cage
63 Bearing plate
64 Raceway
65 Raceway
66 Rolling elements
67 Slot
68 Foot
7 Fixing device
71 Guide sleeve
72 Screw
8 Piece of furniture
81 Cover plate
82 Base panel
83 Side wall
9 Translational-rotational bearing, bearing
91 Bottom plate
92 Rolling element cage
93 Bearing plate
94 Raceway
95 Web
97 Guide channel
99 Opening
10 Piece of furniture
11 Furniture body
111 Work surface
112 Receptacle
12 Furniture element
121 Body
122 Side part
13 Lifting device
131 First telescopic element
132 Second telescopic element
133 Third telescopic element
134 Support plate
14 Ejector element
141 Force accumulator
142 Plunger
15 Fixing device
151 Guide carriage
152 Bearing neck
154 Roller
155 Groove
157 Bearing ring
16 Second lifting device
161 First telescopic element
162 Second telescopic element
163 Third telescopic element
165 Foot
166 Roller element
A Direction
$K_1$, $K_2$, $K_3$ Circle
$R_1$, $R_2$ Direction of rotation
$S_1$, $S_2$ Axis of symmetry
$SK_1$, $SK_2$ Axis of symmetry
U Origin of rotation

The invention claimed is:

1. A furniture element, comprising:
at least one storage level;
a body; and
a bottom plate,
wherein mutually facing bearing surfaces of the body and of the bottom plate each have at least one raceway in which rolling elements are guided,
wherein the body is movable relative to the bottom plate from an initial position to an intermediate position and further to an open position and back,
wherein, in the intermediate position, the body is rotated relative to the bottom plate in a direction of rotation and displaced in a predetermined direction,
wherein the at least one raceway of the bottom plate is formed mirror-symmetrically with respect to an axis of symmetry extending at an oblique angle relative to a side edge of the bottom plate,
wherein the body has a bearing plate on a side facing the bottom plate, wherein the at least one raceway of the body is at least one raceway of the bearing plate that is integrally formed in a side of the bearing plate facing the bottom plate, and wherein the at least one raceway of the bearing plate is formed mirror-symmetrically with respect to an axis of symmetry extending at an oblique angle relative to a side edge of the bearing plate,
wherein the bottom plate, the bearing plate, the rolling elements, and a rolling element cage, in which the rolling elements are accommodated in a captive manner, form a translational-rotational bearing, and
wherein the rolling elements are arranged on at least two circles, wherein axes of symmetry of the rolling element arrangement on a first one of the two circles are inclined by 45° to the axes of symmetry of the rolling element arrangement on a second one of the two circles.

2. The furniture element of claim 1, wherein the axis of symmetry extending at the oblique angle relative to the side edge of the bottom plate extends at an angle of 45° to the side edge of the bottom plate or the axis of symmetry extending at the oblique angle relative to the side edge of the bearing plate extends at an angle of 45° to side edge of the bearing plate.

3. The furniture element of claim 1, wherein a base of the body comprises, on a side facing the bottom plate, a recess in which the bearing plate is fastened.

4. The furniture element of claim 1, wherein the bearing plate is an integral part of a base of the body.

5. The furniture element of claim 1, wherein the at least one of the raceway of the bottom plate is formed as a raceway that is open towards the side edge of the bottom plate.

6. The furniture element of claim 1, wherein the at least one of the raceways formed in the bearing plate is a closed circumferential raceway.

7. The furniture element of claim 1, wherein a further translational-rotational bearing is fixed to a cover plate of the furniture body.

8. The furniture element of claim 1, wherein the body has at least one closed side wall which, in the initial position, blocks access to the at least one storage level and, in an open position rotated through 180° with respect to the initial position, allows access to the at least one storage level.

9. The furniture element of claim 1, wherein the plurality of the rolling elements are arranged in a circular or rectangular shape in the rolling element cage.

10. The furniture element of claim 1, wherein the rolling elements comprise at least two rolling elements arranged radially with respect to an origin of rotation one behind the other in the rolling element cage.

11. The furniture element of claim 1, wherein the at least one raceway of the bearing plate is integrally formed in the bearing plate and forms at least one outer raceway and one inner raceway.

12. The furniture element of claim 11, wherein a third raceway is integrally formed between the outer raceway and the inner raceway.

13. The furniture element of claim 1, further comprising:
a fixing device configured to vertically fixed the bottom plate to the body of the furniture element or to the bearing plate fixed to the body.

14. A piece of furniture, comprising:
a body with a plurality of side walls;
a cover plate; and
at least one furniture element arranged in the piece of furniture, wherein the at least one furniture element comprises
at least one storage level;
a body; and
a bottom plate,
wherein mutually facing bearing surfaces of the body of the at least one furniture element and of the bottom plate each have at least one raceway in which rolling elements are guided,
wherein the body of the at least one furniture element is movable relative to the bottom plate from an initial position to an intermediate position and further to an open position and back,
wherein, in the intermediate position, the body of the at least one furniture element is rotated relative to the bottom plate in a direction of rotation and displaced in a predetermined direction,
wherein the at least one raceway of the bottom plate is formed mirror-symmetrically with respect to an axis of symmetry extending at an oblique angle relative to a side edge of the bottom plate,
wherein the body has a bearing plate on a side facing the bottom plate, wherein the at least one raceway of the body is at least one raceway of the bearing plate that is integrally formed in a side of the bearing plate facing the bottom plate, and wherein the at least one raceway of the bearing plate is formed mirror-symmetrically with respect to an axis of symmetry extending at an oblique angle relative to a side edge of the bearing plate,
wherein the bottom plate, the bearing plate, the rolling elements, and a rolling element cage, in which the rolling elements are accommodated in a captive manner, form a translational-rotational bearing, and
wherein the rolling elements are arranged on at least two circles, wherein axes of symmetry of the rolling element arrangement on a first one of the two circles are inclined by 45° to the axes of symmetry of the rolling element arrangement on a second one of the two circles.

15. The piece of furniture of claim 14, wherein the furniture element is arranged in a corner region of the piece of furniture.

16. The piece of furniture of claim 15, wherein the furniture element comprises two furniture elements that are arranged in at least two of the corner regions of the body of the piece of furniture.

17. The piece of furniture of claim 14, wherein the piece of furniture is a desk.

18. A piece of furniture, comprising:
a first body; and
a furniture element, which comprises
at least one storage level;
a body; and
a bottom plate,
wherein mutually facing bearing surfaces of the body of the at least one furniture element and of the bottom plate each have at least one raceway in which rolling elements are guided,
wherein the body of the at least one furniture element is movable relative to the bottom plate from an initial position to an intermediate position and further to an open position and back,
wherein, in the intermediate position, the body of the at least one furniture element is rotated relative to the bottom plate in a direction of rotation and displaced in a predetermined direction,
wherein the at least one raceway of the bottom plate is formed mirror-symmetrically with respect to an axis of symmetry extending at an oblique angle relative to a side edge of the bottom plate,
wherein the body has a bearing plate on a side facing the bottom plate, wherein the at least one raceway of the body is at least one raceway of the bearing plate that is integrally formed in a side of the bearing plate facing the bottom plate, and wherein the at least one raceway of the bearing plate is formed mirror-symmetrically with respect to an axis of symmetry extending at an oblique angle relative to a side edge of the bearing plate,
wherein the bottom plate, the bearing plate, the rolling elements, and a rolling element cage, in which the rolling elements are accommodated in a captive manner, form a translational-rotational bearing, and
wherein the rolling elements are arranged on at least two circles, wherein axes of symmetry of the rolling element arrangement on a first one of the two circles are inclined by 45° to the axes of symmetry of the rolling element arrangement on a second one of the two circles.

19. The piece of furniture of claim 18, wherein the first body is a body that can be set down in a stationary manner on a floor in a frictionally engaged manner and comprises a first lifting device arranged thereon, wherein a translational-rotational bearing of the furniture element is mounted on the first lifting device.

20. The piece of furniture of claim 18, wherein the first body is a body that can be set down in a stationary manner on a floor in a frictionally engaged manner and comprises a first lifting device arranged thereon, and the furniture element comprises a second lifting device that is actuatable synchronously with the first lifting device, wherein a translational-rotational bearing of the furniture element is mounted on the first lifting device.

21. The piece of furniture of claim 18, wherein the piece of furniture is a desk.

* * * * *